US009899771B2

(12) United States Patent
Ashibu et al.

(10) Patent No.: US 9,899,771 B2
(45) Date of Patent: Feb. 20, 2018

(54) CONNECTOR

(71) Applicant: JAPAN AVIATION ELECTRONICS INDUSTRY, LIMITED, Shibuya-ku, Tokyo (JP)

(72) Inventors: Kenta Ashibu, Tokyo (JP); Yuichi Takenaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/437,498

(22) Filed: Feb. 21, 2017

(65) Prior Publication Data

US 2017/0264048 A1 Sep. 14, 2017

(30) Foreign Application Priority Data

Mar. 14, 2016 (JP) ..... 2016-049755

(51) Int. Cl.

| | |
|---|---|
| ***H01R 12/00*** | (2006.01) |
| ***H05K 1/00*** | (2006.01) |
| ***H01R 13/631*** | (2006.01) |
| ***H01R 13/50*** | (2006.01) |
| ***H01R 24/60*** | (2011.01) |
| *H01R 105/00* | (2006.01) |

(52) U.S. Cl.

CPC ..... *H01R 13/631* (2013.01); *H01R 13/50* (2013.01); *H01R 24/60* (2013.01); *H01R 2105/00* (2013.01)

(58) Field of Classification Search

CPC ..... H01R 12/52; H01R 12/716; H01R 9/096
USPC ..... 439/74
See application file for complete search history.

(56) References Cited

U.S. PATENT DOCUMENTS

| | | | | |
|---|---|---|---|---|
| 7,172,434 | B2 | 2/2007 | Obikane et al. | |
| 9,331,410 | B2 * | 5/2016 | Obikane | H01R 13/02 |
| 9,391,398 | B2 | 7/2016 | Omodachi et al. | |
| 9,478,902 | B2 | 10/2016 | Komoto et al. | |
| 9,666,963 | B2 * | 5/2017 | He | H01R 12/716 |

(Continued)

FOREIGN PATENT DOCUMENTS

| | | | |
|---|---|---|---|
| JP | 2006331679 | A | 12/2006 |
| JP | 2014175304 | A | 9/2014 |

(Continued)

*Primary Examiner* — Abdullah Riyami
*Assistant Examiner* — Thang Nguyen
(74) *Attorney, Agent, or Firm* — Holtz, Holtz & Volek PC

(57) ABSTRACT

A connector is mateable with a mating connector along an up-down direction. The connector comprises a contact, a holding member and two reinforcing members. The holding member has an accommodation portion and an island-like portion. The island-like portion has two end portions in a first horizontal direction perpendicular to the up-down direction. The reinforcing members are positioned at the two end portions, respectively. Each of the reinforcing members has a guard portion and a supporter. The guard portion of each of the reinforcing members guards the corresponding end portion of the island-like portion. The guard portion has an upper surface, an embedded portion and an exposed coupling portion. The upper surface is exposed upward from the island-like portion in the up-down direction. The embedded portion is embedded into the island-like portion. The exposed coupling portion couples the upper surface and the embedded portion with each other.

13 Claims, 15 Drawing Sheets

(56) References Cited

U.S. PATENT DOCUMENTS

| | | | | |
|---|---|---|---|---|
| 2006/0264075 | A1* | 11/2006 | Obikane ..... | H01R 24/60<br>439/74 |
| 2015/0303597 | A1 | 10/2015 | He | |

FOREIGN PATENT DOCUMENTS

| | | | |
|---|---|---|---|
| JP | 2014182935 | A | 9/2014 |
| JP | 2015106529 | A | 6/2015 |
| JP | 2015185541 | A | 10/2015 |
| JP | 2015207557 | A | 11/2015 |

* cited by examiner

CONNECTOR

CROSS REFERENCE TO RELATED APPLICATIONS

This application is based on and claims priority under 35 U.S.C. § 119 to Japanese Patent Application No. JP2016-049755 filed Mar. 14, 2016, the contents of which are incorporated herein in their entirety by reference.

BACKGROUND OF THE INVENTION

This invention relates to a connector mateable with a mating connector.

Referring to FIGS. 29 and 30, JP-A 2015-207557 (Patent Document 1) discloses a connector 900 which is mateable with a mating connector (not shown) along a Z-direction. The connector 900 comprises a plurality of data terminals 910, a housing 920 and two terminals 930. Specifically, the housing 920 holds the data terminals 910, and the terminals 930 are attached to the housing 920. The housing 920 has a loop frame 922, a receiving portion 926 and a boss 928, namely, an island-like portion. The receiving portion 926 is configured to receive a mating connector (not shown). The boss 928 is arranged in the receiving portion 926 and protrudes upward. The loop frame 922 has longitudinal frames 923 and lateral frames 924. Specifically, each of the longitudinal frames 923 extends in an X-direction, and each of the lateral frames 924 extends in a Y-direction. The boss 928 extends long in the X-direction and is formed with restriction grooves 929. The restriction grooves 929 are positioned at opposite ends, respectively, of the boss 922 in the X-direction. Each of the terminals 930 comprises a first U-shaped portion 932, two second U-shaped portions 934 and a third U-shaped portion 936. The first U-shaped portion 932 covers the lateral frame 924 of the loop frame 922 of the housing 920. Each of the second U-shaped portions 934 covers the longitudinal frame 923 of the loop frame 922 of the housing 920. The third U-shaped portion 936 extends inward from the first U-shaped portion 932 and has a tongue portion 937 at an end thereof in the X-direction. The tongue portion 937 of the third U-shaped portion 936 is arranged so as to be movable in the restriction groove 929 of the boss 928.

In the connector of Patent Document 1, there is a possibility that the connector and the mating connector (not shown) cannot be properly mated with each other by damaging the boss 928 or/and the tongue portion 929 of the connector 900 when the connector and the mating connector (not shown) are mated with each other under a state where the connector and the mating connector (not shown) are misaligned with each other.

SUMMARY OF THE INVENTION

It is therefore an object of the present invention to provide a connector which prevents an island-like portion from being damaged when the connector and a mating connector are mated with each other under a state where the connector and the mating connector are misaligned with each other.

One aspect of the present invention provides a connector mateable with a mating connector along an up-down direction. The connector comprises a contact, a holding member and two reinforcing members. The holding member holds the contact. The two reinforcing members are embedded into the holding member. The holding member has an accommodation portion and an island-like portion. The accommodation portion is configured to accommodate a part of the mating connector. The island-like portion is arranged in the accommodation portion and protrudes upward in the up-down direction. The island-like portion extends long in a first horizontal direction perpendicular to the up-down direction. The island-like portion has two end portions in the first horizontal direction. The reinforcing members are positioned at the two end portions, respectively. Each of the reinforcing members has a guard portion and a supporter. The guard portion of each of the reinforcing members guards the corresponding end portion of the island-like portion. The supporter supports the guard portion. The guard portion has an upper surface, an embedded portion and an exposed coupling portion. The upper surface is exposed upward from the island-like portion in the up-down direction. The embedded portion is embedded into the island-like portion. The exposed coupling portion couples the upper surface and the embedded portion with each other and is exposed from the island-like portion. The supporter has a first supporting portion and a second supporting portion. Each of the first supporting portion and the second supporting portion extends downward from the upper surface in the up-down direction in a first plane or in a second plane. The first plane is defined by the first horizontal direction and the up-down direction. The second plane is defined by a second horizontal direction and the up-down direction. The second horizontal direction is perpendicular to both the first horizontal direction and the up-down direction. In the up-down direction, the second supporting portion has a size which is not less than one half a size of the first supporting portion and which is not greater than the size of the first supporting portion.

The connector of the present invention is provided with the guard portions at the two end portions, respectively, of the island-like portion. Accordingly, the island-like portion can be prevented from being damaged when the connector and the mating connector are mated with each other under the state where the connector and the mating connector are misaligned with each other.

The connector of the present invention is provided with the supporter which supports the guard portion. In other words, the guard portion is reinforced by the supporter. Accordingly, the connector of the present invention has a structure which prevents deformation of the upper surface of the guard portion when the connector and the mating connector are mated with each other under the state where the connector and the mating connector are misaligned with each other.

An appreciation of the objectives of the present invention and a more complete understanding of its structure may be had by studying the following description of the preferred embodiment and by referring to the accompanying drawings.

Figure 1:
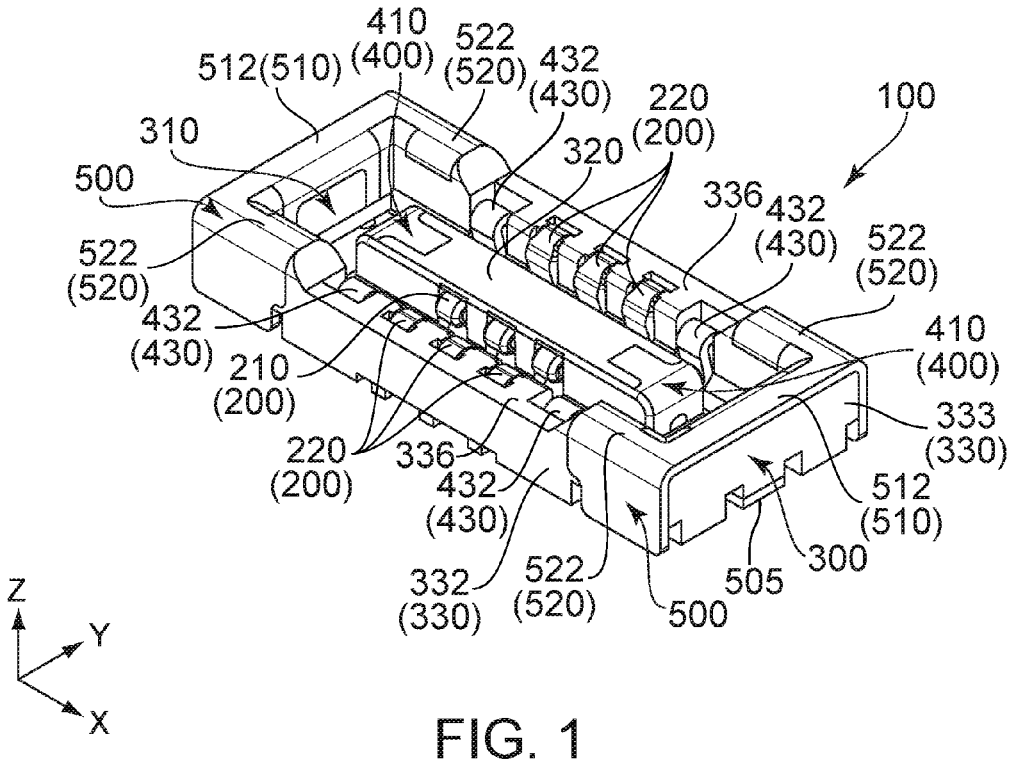
FIG. 1 is a perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIGS. 1 to 6, a connector 100 according to a first embodiment of the present invention is mateable with a mating connector (not shown) along an up-down direction. In the present embodiment, the up-down direction is a Z-direction. Specifically, upward is a positive Z-direction, and downward is a negative Z-direction.

As shown in FIGS. 1 to 6, the connector 100 of the present embodiment comprises a holding member 300, a plurality of contacts 200, two reinforcing members 400 and two guide members 500. Specifically, the contacts 200 are held by the holding member 300, and the reinforcing members 400 are embedded into the holding member 300.

Figure 3:
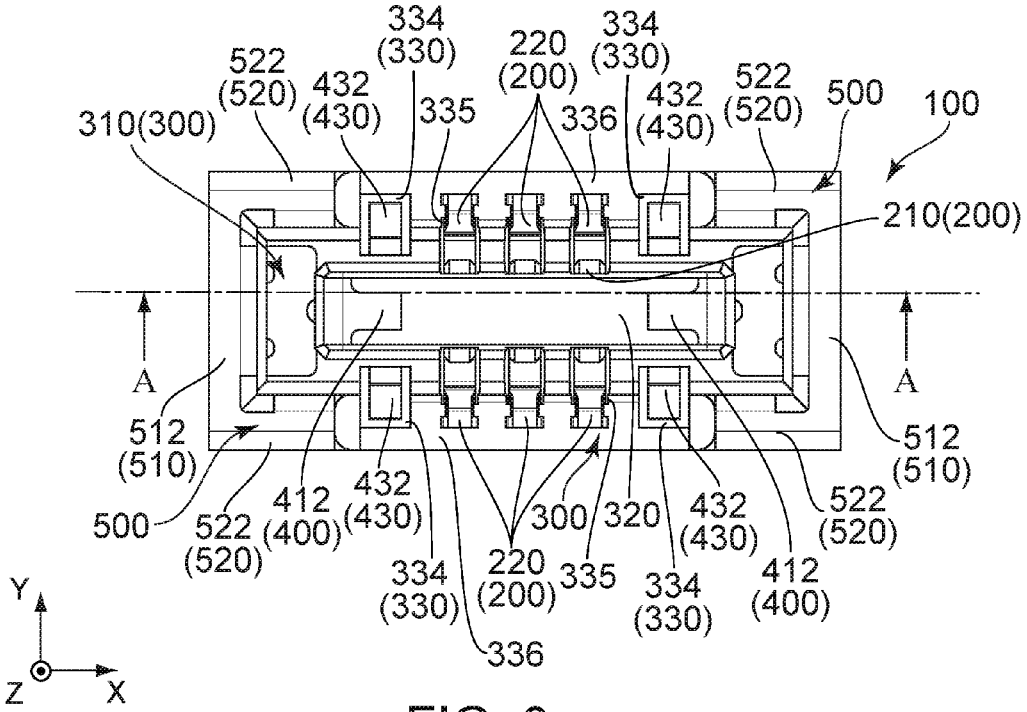
FIG. 3 is a top view showing the connector of FIG. 1.
Figure 6:
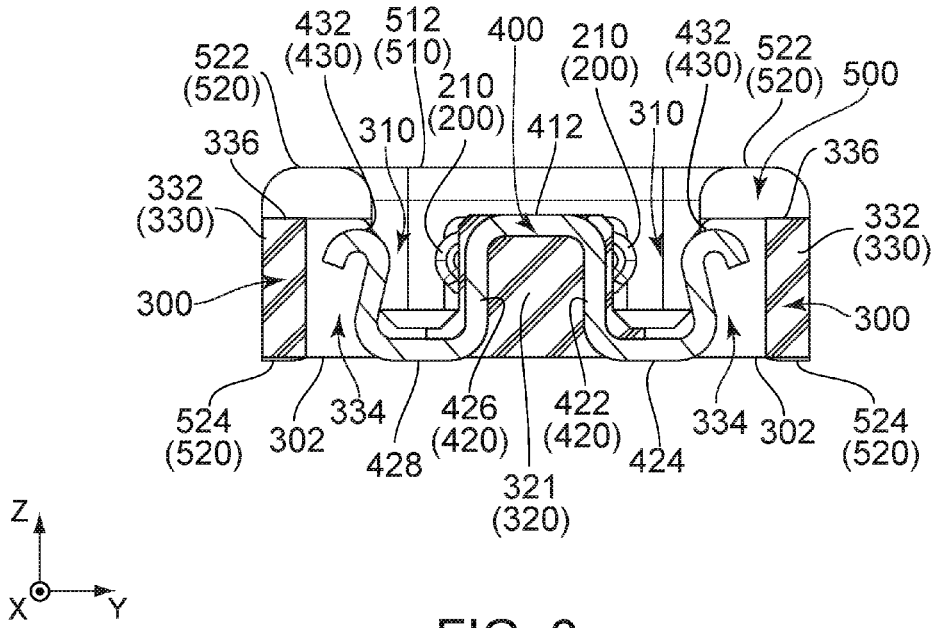
FIG. 6 is a cross-sectional view showing the connector of FIG. 4, taken along line B-B.

As shown in FIGS. 1, 3 and 6, the holding member 300 is made of resin and has an accommodation portion 310, an island-like portion 320 and a surrounding portion 330.

As shown in FIGS. 1 and 3, the accommodation portion 310 accommodates a part of the mating connector (not shown) when the connector 100 and the mating connector (not shown) are mated with each other. The accommodation portion 310 has a roughly angular O-shape in a plane perpendicular to the up-down direction. In the present embodiment, the plane perpendicular to the up-down direction is an XY-plane.

Figure 5:
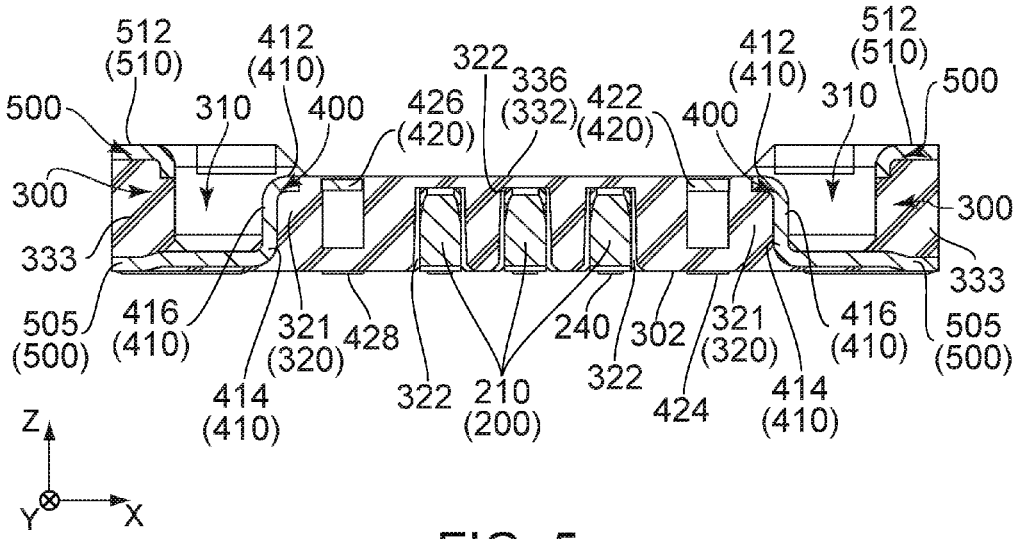
FIG. 5 is a cross-sectional view showing the connector of FIG. 3, taken along line A-A.

As shown in FIGS. 1, 3 and 5, the island-like portion 320 is arranged in the accommodation portion 310 and protrudes upward in the up-down direction. More specifically, the island-like portion 320 extends long in a first horizontal direction perpendicular to the up-down direction and has two end portions 321 at opposite ends, respectively, thereof in the first horizontal direction. In the present embodiment, the first horizontal direction is an X-direction.

As shown in FIG. 5, the island-like portion 320 has opposite ends in a second horizontal direction perpendicular to both the up-down direction and the first horizontal direction, and each of the opposite ends of the island-like portion 320 in the second horizontal direction is provided with three first contact portion accommodation portions 322. In the present embodiment, the second horizontal direction is a Y-direction. Each of the first contact portion accommodation portions 322 is recessed inward in the second horizontal direction.

As shown in FIGS. 1 to 6, the surrounding portion 330 has two first facing walls (facing walls) 332 and two second facing walls 333.

The first facing walls 332 are positioned at opposite ends, respectively, of the connector 100 in the second horizontal direction. Each of the first facing walls 332 faces the island-like portion 320 in the second horizontal direction. Each of the first facing walls 332 is formed with two recesses 334 and three second contact portion accommodation portions 335. Each of the second contact portion accommodation portions 335 is positioned between the two recesses 334 in the first horizontal direction. Each of the recesses 334 is recessed outward in the second horizontal direction. Each of the second contact portion accommodation portions 335 is recessed outward in the second horizontal direction. The recesses 334 correspond to the reinforcing members 400, respectively.

The second facing walls 333 are positioned at opposite ends, respectively, of the connector 100 in the first horizontal direction. The second facing walls 333 face the end portions 321, respectively, of the island-like portion 320 in the first horizontal direction.

As shown in FIGS. 1 and 3, in the plane perpendicular to the up-down direction, namely, in the XY-plane, the surrounding portion 330 has a roughly angular O-shape and surrounds the accommodation portion 310. More specifically, the surrounding portion 330 surrounds the island-like portion 320 through the accommodation portion 310 in the XY-plane.

As shown in FIGS. 1 to 6, each of the contacts 200 is made of conductor and has a first contact portion 210, a second contact portion 220, a coupling portion 230 and a fixed portion 240. The first contact portion 210 and the second contact portion 220 are coupled with each other by the coupling portion 230. The first contact portion 210 and the second contact portion 220 face each other in the second horizontal direction. The fixed portion 240 extends outward in the second horizontal direction from the second contact portion 220. The first contact portion 210 is accommodated in the first contact portion accommodation portion 322 of the island-like portion 320 so as to be movable in the second horizontal direction. The second contact portion 220 is accommodated in the second contact portion accommodation portion 335 of the first facing wall 332 of the surrounding portion 330.

As shown in FIGS. 1, 3, 5 and 6, the reinforcing members 400 are positioned at the two end portions 321, respectively, of the island-like portion 320 in the first horizontal direction.

As shown in FIGS. 1, 3 and 6 to 13, each of the reinforcing members 400 has a symmetrical structure with respect to a plane, wherein the plane is defined by the first horizontal direction and the up-down direction while passing through a center of the reinforcing member 400 in the second horizontal direction. In the present embodiment, the plane defined by the first horizontal direction and the up-down direction is an XZ-plane.

As shown in FIGS. 1, 3 and 5 to 14, each of the reinforcing members 400 is made of metal and has a guard portion 410, a supporter 420, a first lower exposed portion (lower exposed portion) 424, a second lower exposed portion 428 and two resilient pieces 430. Specifically, the guard portion 410 of each of the reinforcing members 400 guards the corresponding end portion 321 of the island-like portion 320, and the supporter 420 supports the guard portion 410.

As shown in FIGS. 5 and 7 to 14, the guard portion 410 has an upper surface 412, embedded portions 414 and an exposed coupling portion 416.

As shown in FIGS. 1, 3, 5 and 6, the upper surface 412 is exposed upward from the island-like portion 320 in the up-down direction. More specifically, the upper surface 412 of the present embodiment is perpendicular to the up-down direction.

As shown in FIGS. 5 and 7 to 14, the exposed coupling portion 416 extends downward from an outward end of the upper surface 412 in the first horizontal direction. Specifically, in the illustrated reinforcing member 400, the exposed coupling portion 416 extends downward from a positive X-side end of the upper surface 412. More specifically, the exposed coupling portion 416 couples the upper surface 412 and the embedded portions 414 with each other and is exposed from the island-like portion 320.

Figure 7:
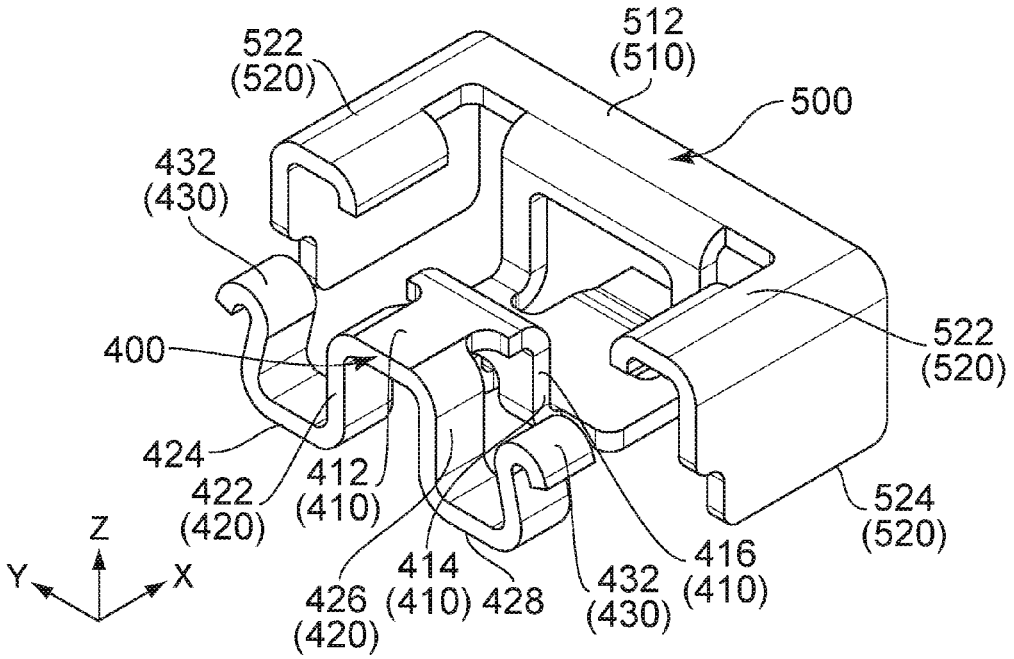
FIG. 7 is a perspective view showing one of reinforcing members which are included in the connector of FIG. 1.
Figure 9:
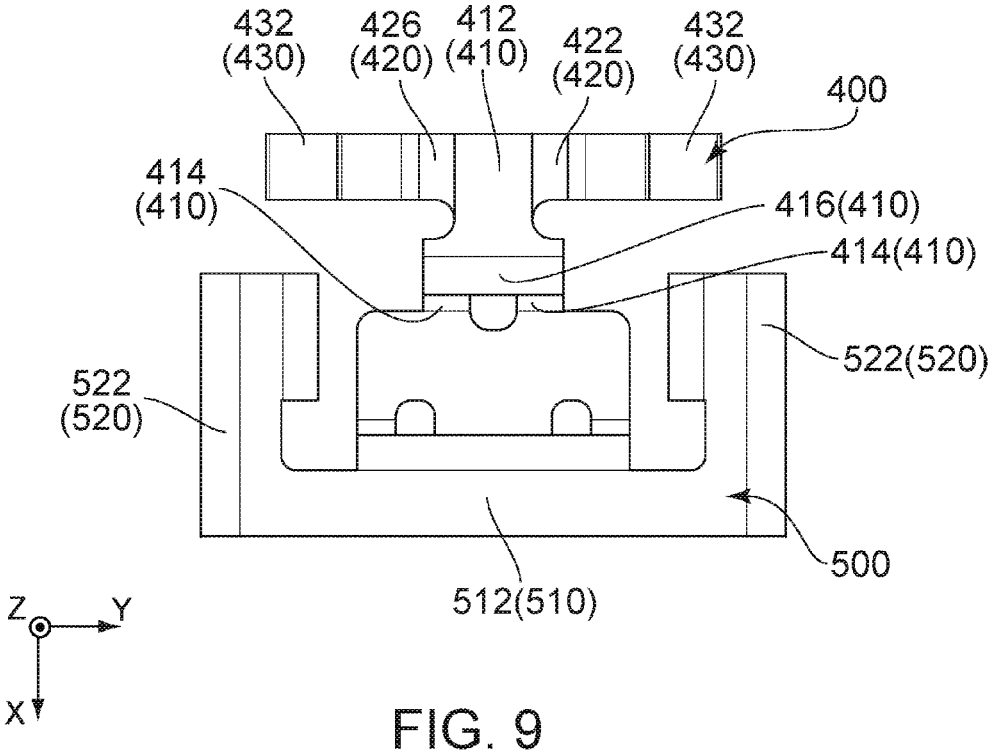
FIG. 9 is a top view showing the reinforcing member of FIG. 7.
Figure 10:
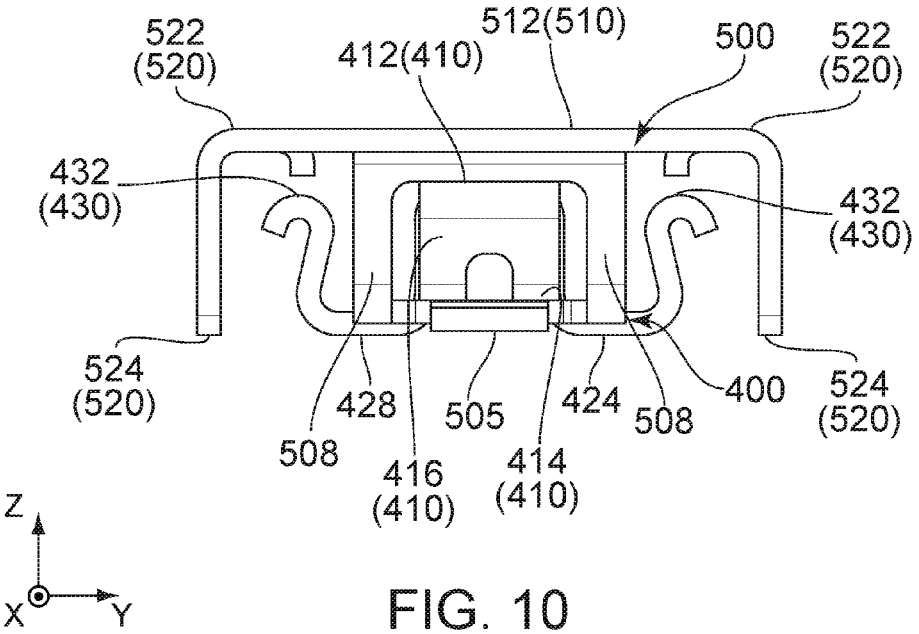
FIG. 10 is a rear view showing the reinforcing member of FIG. 7.

As shown in FIGS. 5, 7 and 9, the embedded portions 414 extend downward from lower ends, respectively, of the exposed coupling portion 416. Specifically, the embedded portions 414 of the guard portion 410 of each of the reinforcing members 400 are embedded into the corresponding end portion 321 of the island-like portion 320.

Figure 8:
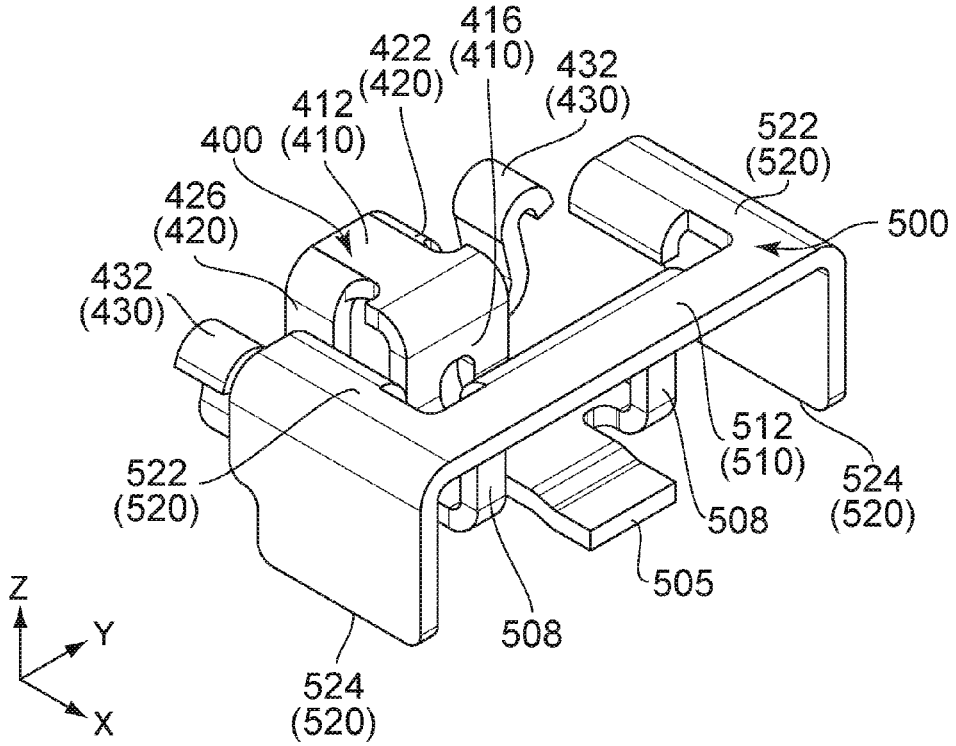
FIG. 8 is a rear, perspective view showing the reinforcing member of FIG. 7.

As shown in FIGS. 6 to 8, the supporter 420 has a first supporting portion 422 and a second supporting portion 426. Specifically, each of the first supporting portion 422 and the second supporting portion 426 extends downward from the upper surface 412 in the up-down direction in a plane defined by the second horizontal direction and the up-down direction. In the present embodiment, the plane defined by the second horizontal direction and the up-down direction is a YZ-plane. More specifically, the first supporting portion 422 extends downward from one of two ends of the upper surface 412 of the guard portion 410 in the second horizontal direction, and the second supporting portion 426 extends downward from a remaining one of the two ends of the upper surface 412 of the guard portion 410. In the up-down direction, the second supporting portion 426 has a size which is not less than one half a size of the first supporting portion 422 and which is not greater than the size of the first supporting portion 422. In other words, in the up-down direction, the second supporting portion 426 has a size A which satisfies a condition $B/2 \leq A \leq B$, wherein B is the size of the first supporting portion 422 in the up-down direction. More specifically, in the up-down direction, the second supporting portion 426 of the present embodiment has a size equal to the size of the first supporting portion 422.

As understood from FIGS. 6 to 14, in the connector 100 of the present embodiment, each of the two end portions 321 of the island-like portion 320 is provided with the guard portion 410. Accordingly, the island-like portion 320 is prevented from being damaged when the connector 100 and the mating connector (not shown) are mated with each other under a state where the connector 100 and the mating connector (not shown) are misaligned with each other. In particular, even if downward force is applied to the upper surface 412 by a mating end (not shown) of the mating connector (not shown) abutting against the upper surface 412 of the guard portion 410 of the connector 100 when the connector 100 and the mating connector (not shown) are mated with each other, the upper surface 412 is prevented from being deformed because the upper surface 412 is supported by the first supporting portion 422 and the second supporting portion 426, which are symmetrically arranged with each other, so that the force applied to the upper surface 412 is distributed to the first supporting portion 422 and the second supporting portion 426 in a balanced manner.

As shown in FIGS. 1, 3, 5 and 6, a region, which is defined by the first supporting portion 422, the second supporting portion 426 and the upper surface 412 of the guard portion 410, is filled with the resin of the holding member 300. In other words, in the region defined by the first supporting portion 422, the second supporting portion 426 and the upper surface 412 of the guard portion 410, there is no area where the resin of the holding member 300 does not exist. Accordingly, even in a case where the mating connector (not shown) abuts against the upper surface 412 of the reinforcing member 400 when the connector 100 and the mating connector (not shown) are mated with each other, the upper surface 412 of the guard portion 410 is never deformed, so that deformation of the reinforcing member 400 and damage to the island-like portion 320 can be more prevented.

As shown in FIGS. 2, 6, 7, 12 and 13, the first lower exposed portion 424 extends outward from a lower end of the first supporting portion 422 in the second horizontal direction and is exposed downward from the holding member 300 in the up-down direction. More specifically, in the up-down direction, the first lower exposed portion 424 is positioned at a position same as a position of a bottom surface 302 of the holding member 300 or protrudes downward from the bottom surface 302 of the holding member 300. The first lower exposed portion 424 of the present embodiment protrudes downward from the bottom surface 302 of the holding member 300 in the up-down direction.

As shown in FIGS. 2, 6, 7, 12 and 13, the second lower exposed portion 428 extends outward from a lower end of the second supporting portion 426 in the second horizontal direction and is exposed downward from the holding member 300 in the up-down direction. More specifically, in the up-down direction, the second lower exposed portion 428 is positioned at a position same as a position of the bottom surface 302 of the holding member 300 or protrudes downward from the bottom surface 302 of the holding member 300. The second lower exposed portion 428 of the present embodiment protrudes downward from the bottom surface 302 of the holding member 300 in the up-down direction.

As shown in FIGS. 6 to 13, the upper surface 412 of the guard portion 410 is positioned between the first lower exposed portion 424 and the second lower exposed portion 428 in the second horizontal direction. A part of the upper surface 412 of the guard portion 410 is positioned at a position same as a position of each of the first lower exposed portion 424 and the second lower exposed portion 428 in the first horizontal direction. The upper surface 412 of the guard portion 410 is positioned above each of the first lower exposed portion 424 and the second lower exposed portion 428 in the up-down direction.

As described above, the connector 100 of the present embodiment has the first lower exposed portion 424, which extends from the first supporting portion 422, and the second lower exposed portion 428 which extends from the second supporting portion 426. In a case where downward force is applied to the upper surface 412 by the mating connector (not shown) abutting against the upper surface 412 of the guard portion 410 of the connector 100 when the mating connector (not shown) is mated with the connector 100 mounted on a circuit board (not shown), each of the first lower exposed portion 424 and the second lower exposed portion 428 is moved downward to abut against the circuit board (not shown). In other words, the downward force applied to the upper surface 412 is received by the circuit board (not shown) through the first lower exposed portion 424 and the second lower exposed portion 428. Accordingly, the upper surface 412 is more prevented from being deformed.

As shown in FIGS. 1, 3 and 6, each of the resilient pieces 430 is brought into contact with the mating connector (not shown) when the connector 100 and the mating connector (not shown) are mated with each other. One of the resilient pieces 430 extends upward from one of two ends, or an outward end, of the first lower exposed portion 424 in the second horizontal direction, and a remaining one of the resilient pieces 430 extends upward from one of two ends, or an outward end, of the second lower exposed portion 428 in the second horizontal direction. In the second horizontal direction, the island-like portion 320 is spaced apart from the two resilient pieces 430 and is positioned between the two resilient pieces 430. The first facing walls 332 correspond to the resilient pieces 430, respectively. The resilient piece 430 is accommodated by the recess 334 of the first facing wall 332. Specifically, each of the resilient pieces 430 of each of the reinforcing members 400 is accommodated by the corresponding recess 334 of the corresponding first facing wall 332. In other words, the recess 334 of the first facing wall 332 allows the resilient piece 430 to be deformed. Specifically, each of the recesses 334 of each of the first facing walls 332 allows the corresponding resilient piece 430 of the corresponding reinforcing member 400 to be deformed. An upper end 432 of the resilient piece 430 is positioned below an upper surface 336 of the first facing wall 332 in the up-down direction. Specifically, the upper end 432 of each of the resilient pieces 430 is positioned below the upper surface 336 of the corresponding first facing wall 332 in the up-down direction.

As shown in FIGS. 1, 3 and 7 to 14, the guide members 500 correspond to the reinforcing members 400, respectively, and each of the guide members 500 is formed integrally with the corresponding reinforcing member 400. The reinforcing members 400 and the guide members 500 are embedded into the holding member 300 via insert-molding. Each of the guide members 500 is made of metal and has a first guide portion 510, two second guide portions 520, a fixed portion 505 and coupling portions 508.

As shown in FIGS. 1, 3, 5 and 7 to 14, the first guide portion 510 faces the guard portion 410 of the reinforcing member 400 in the first horizontal direction. Specifically, the first guide portion 510 of each of the guide members 500 faces the guard portion 410 of the corresponding reinforcing member 400 in the first horizontal direction. More specifically, the first guide portion 510 of each of the guide members 500 faces each of the exposed coupling portion 416 and the embedded portions 414 of the guard portion 410 of the corresponding reinforcing member 400 in the first horizontal direction.

As shown in FIGS. 1 and 3, the second guide portions 520 are positioned to interpose the accommodation portion 310 of the holding member 300 therebetween in the second horizontal direction.

Figure 11:
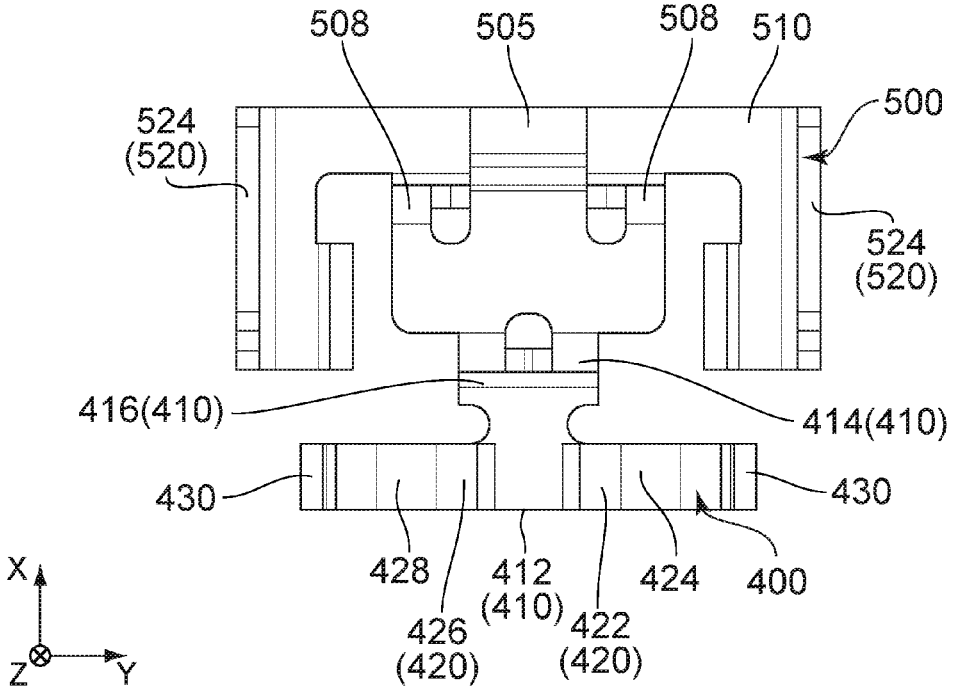
FIG. 11 is a bottom view showing the reinforcing member of FIG. 7.
Figure 12:
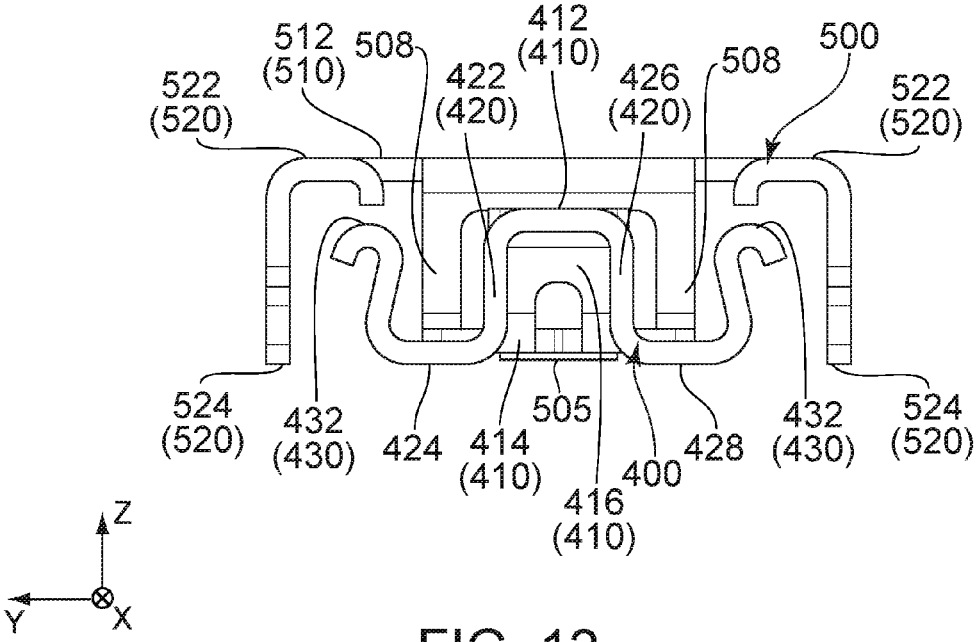
FIG. 12 is a front view showing the reinforcing member of FIG. 7.
Figure 13:
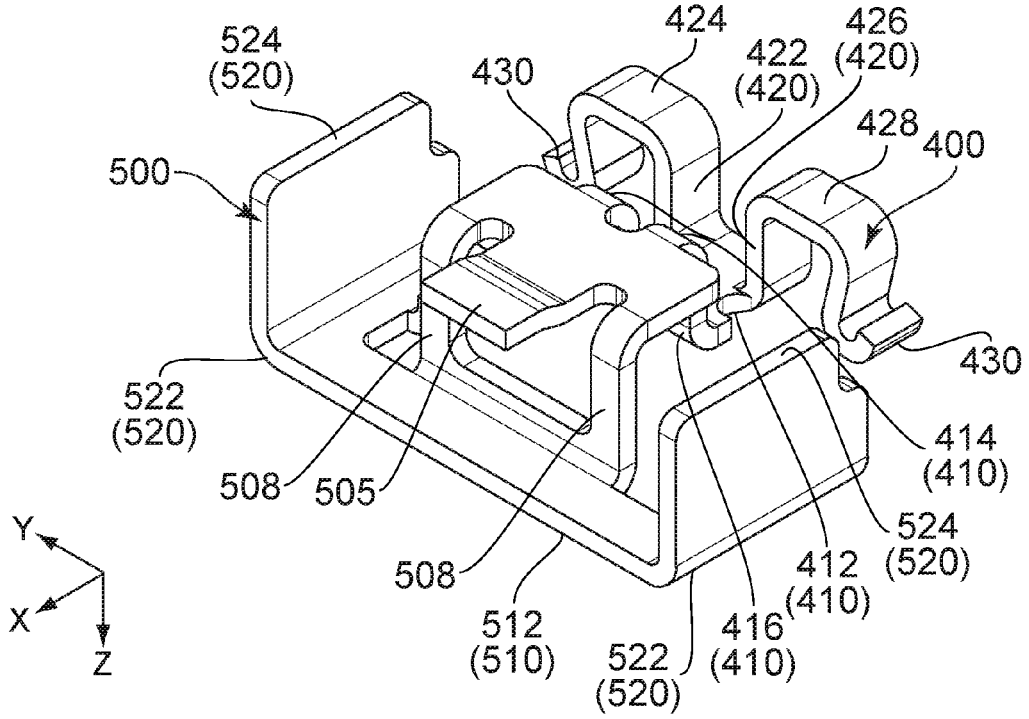
FIG. 13 is a perspective view showing a bottom surface of the reinforcing member of FIG. 7.
Figure 14:
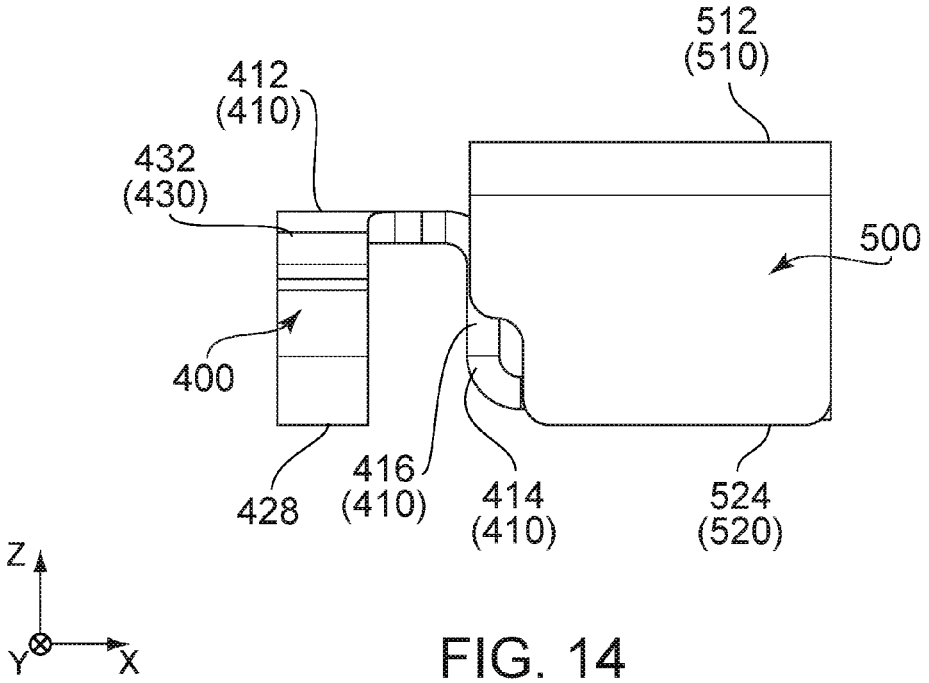
FIG. 14 is a side view showing the reinforcing member of FIG. 7.

As shown in FIGS. 11 and 13, the fixed portion 505 of the illustrated guide member 500 extends in a positive X-direction from positive X-side ends of the embedded portions 414 of the guard portion 410 of the reinforcing member 400, and a positive X-side end of the fixed portion 505 is a free end.

As shown in FIGS. 8 and 10 to 13, each of the coupling portions 508 of the illustrated guide member 500 extends downward from a negative X-side end of the first guide portion 510 of the guide member 500. In detail, the coupling portions 508 correspond to opposite ends, respectively, of the fixed portion 505 in the second horizontal direction, and the first guide portion 510 and each of the opposite ends of the fixed portion 505 are coupled with each other by the corresponding coupling portion 508.

Figure 2:
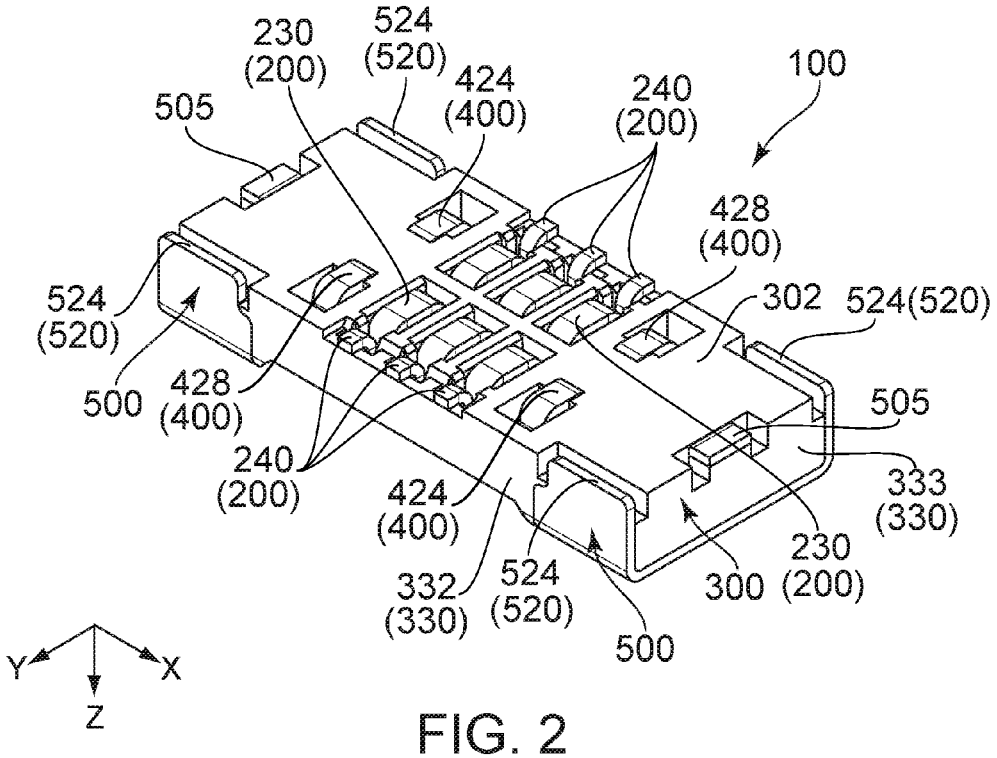
FIG. 2 is a perspective view showing a bottom surface of the connector of FIG. 1.
Figure 4:
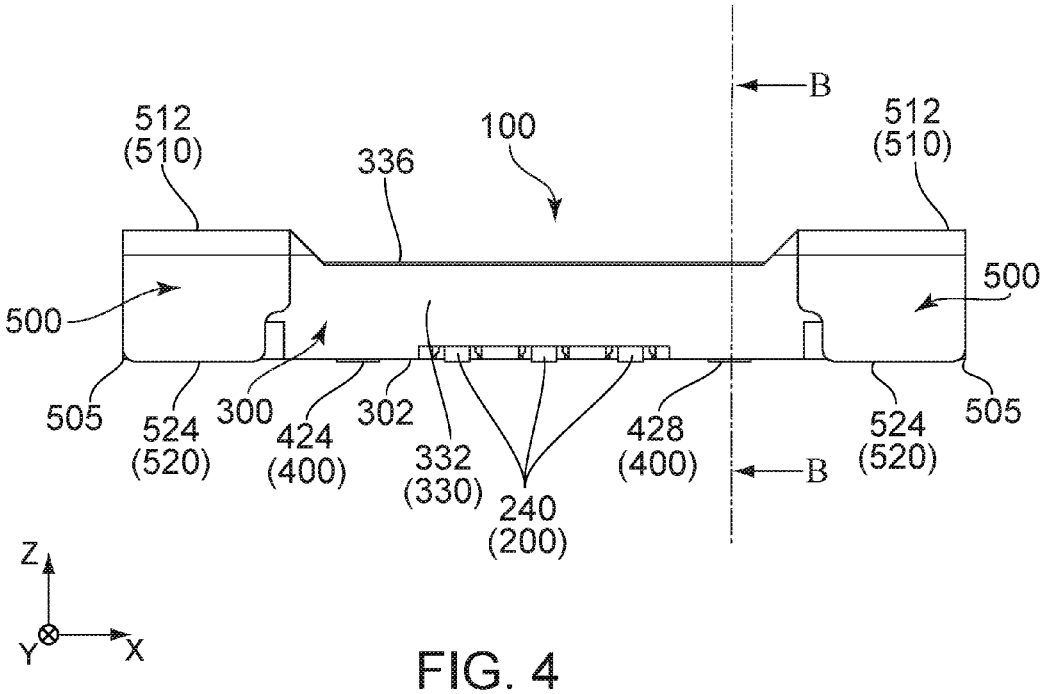
FIG. 4 is a side view showing the connector of FIG. 1.

As understood from FIGS. 2, 4 and 5, a lower end 524 of each of the second guide portions 520 and the free end of the fixed portion 505 of the guide member 500 are configured to be soldered on the circuit board (not shown).

As understood from FIGS. 2 and 4, each of the first lower exposed portion 424 and the second lower exposed portion 428 of the present embodiment is positioned above any of the lower end 524 of each of the second guide portions 520 and the free end of the fixed portion 505 in the up-down direction. In addition, each of the first lower exposed portion 424 and the second lower exposed portion 428 is positioned below the bottom surface 302 of the holding member 300 in the up-down direction. In order to secure a spring property of each of the resilient pieces 430, each of the first lower exposed portion 424 and the second lower exposed portion 428 of the present embodiment is not soldered on the circuit board (not shown).

As shown in FIGS. 5 and 6, in the up-down direction, the upper surface 412 of the guard portion 410 is positioned below any of an upper end 512 of the first guide portion 510 and an upper end 522 of each of the second guide portions 520. Specifically, in the up-down direction, the upper surface 412 of the guard portion 410 of each of the reinforcing members 400 is positioned below any of the upper end 512 of the first guide portion 510 and the upper end 522 of each of the second guide portions 520 of the corresponding guide member 500. Accordingly, in a case where the mating end (not shown) of the mating connector (not shown) is misaligned with the accommodation portion 310 of the holding member 300 of the connector 100 in the XY-plane when the connector 100 and the mating connector (not shown) are mated with each other, the mating end (not shown) of the mating connector (not shown) is brought into contact with the upper end 512 of the first guide portion 510 or/and the upper end 522 of the second guide portion 520 of the connector 100 before being brought into contact with the island-like portion 320 or/and the reinforcing member 400 of the connector 100. Thus, in the aforementioned case, the mating end (not shown) of the mating connector (not shown) is guided toward the accommodation portion 310 of the holding member 300 of the connector 100.

Second Embodiment

Referring to FIGS. 15 to 28, a connector 100A according to a second embodiment of the present invention has a structure same as that of the connector 100 according to the aforementioned first embodiment as shown in FIG. 1 except for reinforcing members 400A. Accordingly, components of the connector 100A shown in FIGS. 15 to 28 which are same as those of connector 100 of the first embodiment are referred by using reference signs same as those of the connector 100 of the first embodiment.

Figure 15:
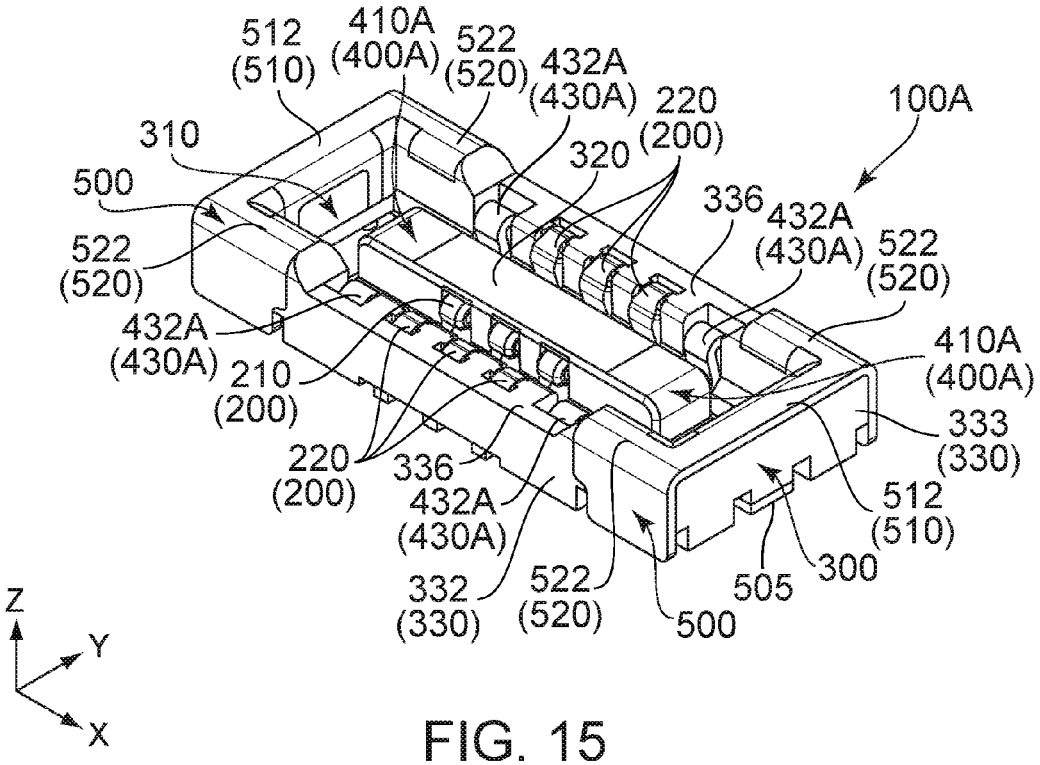
FIG. 15 is a perspective view showing a connector according to a second embodiment of the present invention.
Figure 16:
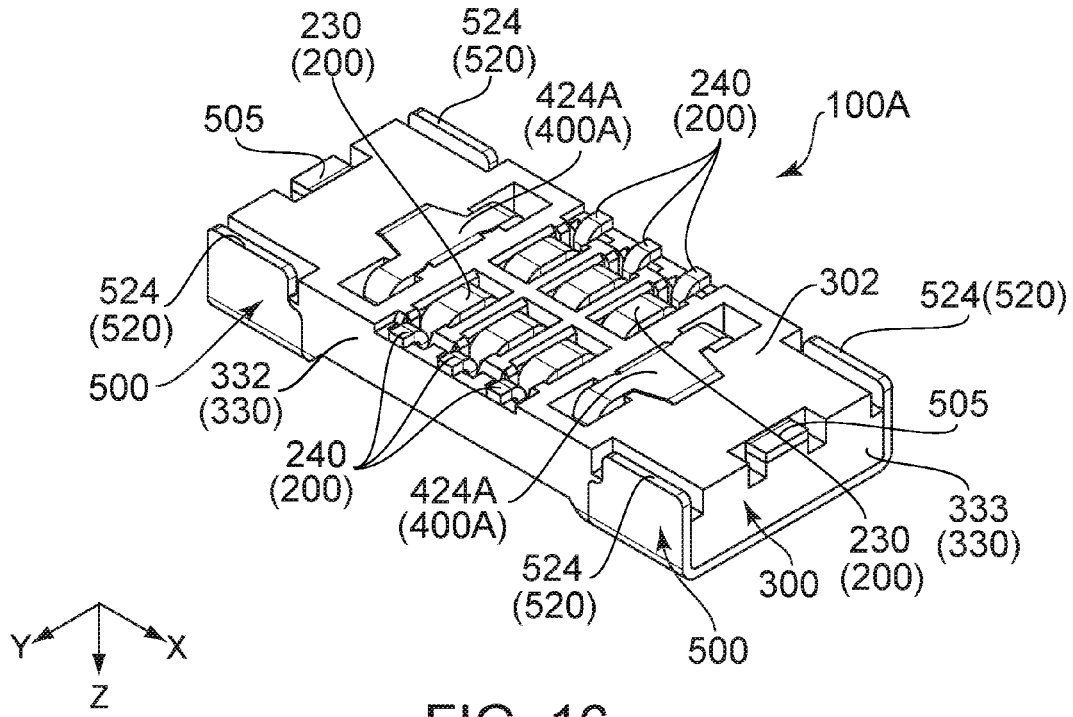
FIG. 16 is a perspective view showing a bottom surface of the connector of FIG. 15.
Figure 17:
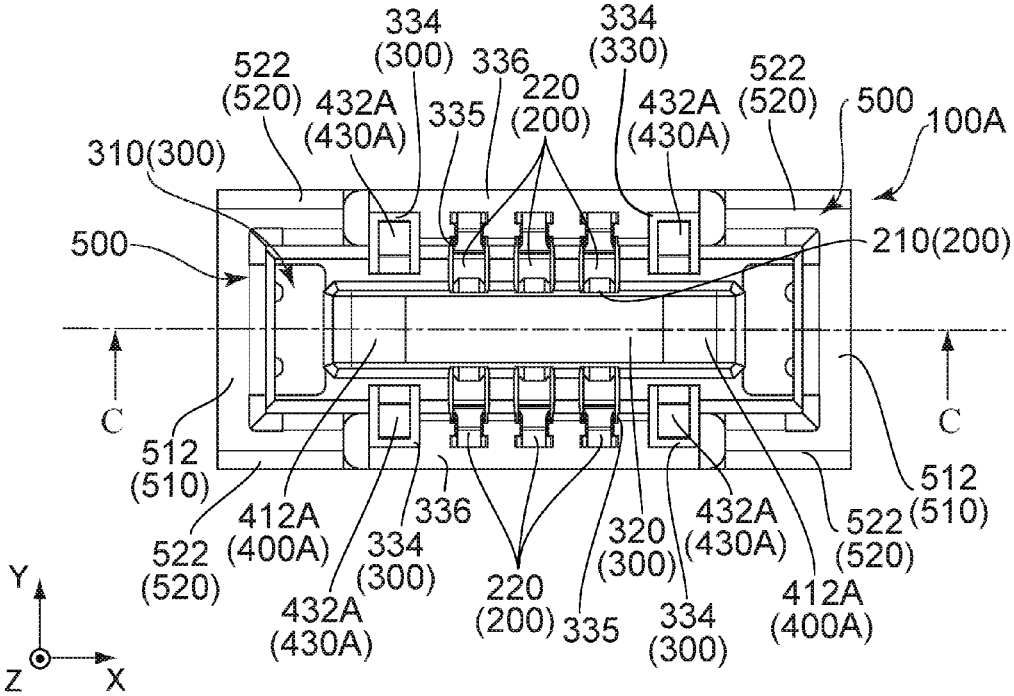
FIG. 17 is a top view showing the connector of FIG. 15.
Figure 18:
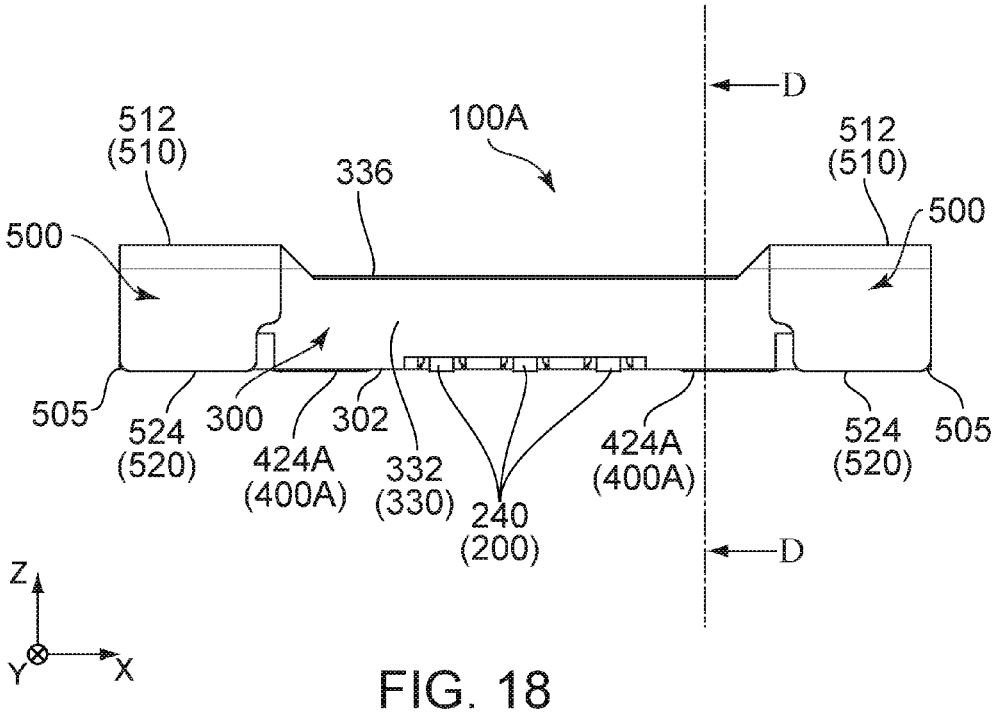
FIG. 18 is a side view showing the connector of FIG. 15.
Figure 20:
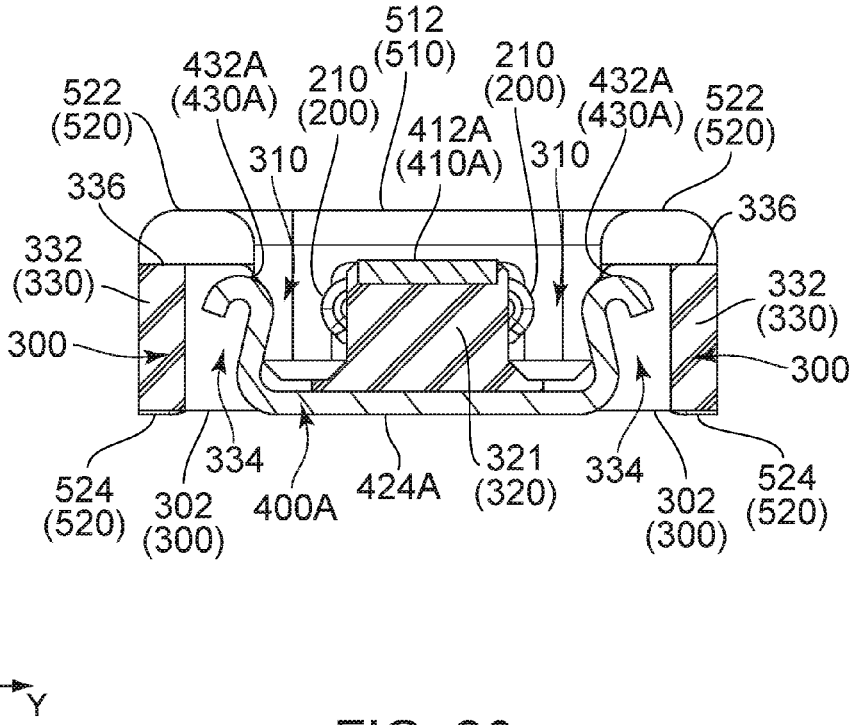
FIG. 20 is a cross-sectional view showing the connector of FIG. 18, taken along line D-D.
Figure 21:
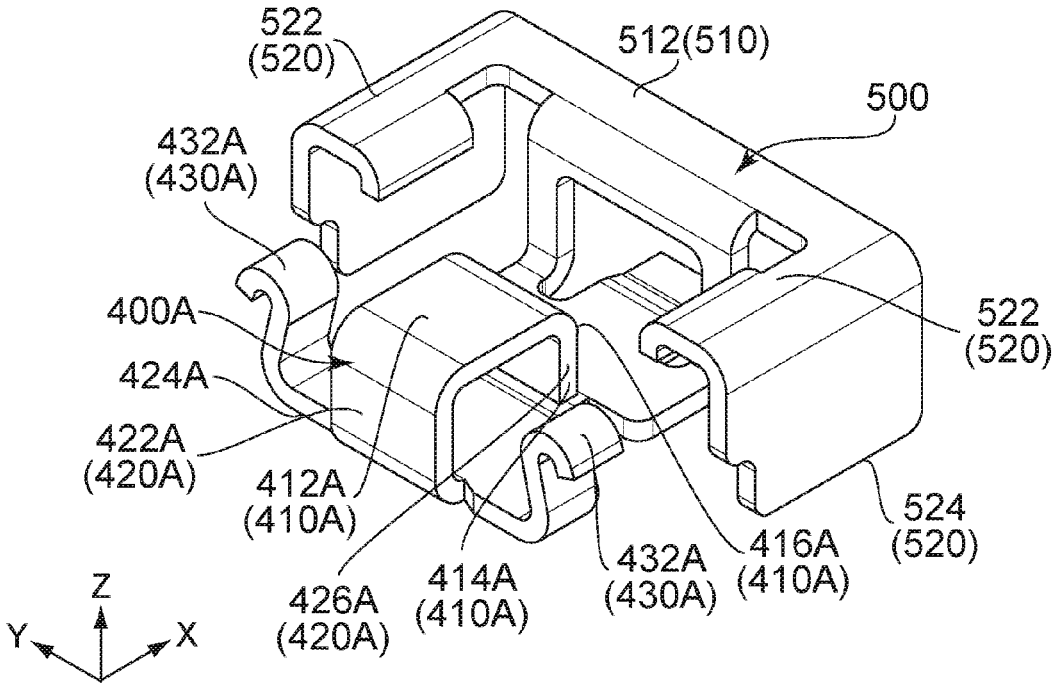
FIG. 21 is a perspective view showing one of reinforcing members which are included in the connector of FIG. 15.

As understood from FIGS. 15, 17 and 20, the connector 100A of the present embodiment comprises a plurality of contacts 200, a holding member 300, the two reinforcing members 400A and two guide members 500. Specifically, the contacts 200 are held by the holding member 300, and the reinforcing members 400A are embedded into the holding member 300. As for the aforementioned components of the connector 100A, the contact 200 and the guide member 500 have structures same as those of the connector 100 of the aforementioned first embodiment. Although the holding member 300 of the connector 100A has a structure different in detail from that of the connector 100 of the first embodiment because the reinforcing members 400A, which are embedded into the connector 100A, are dissimilar to the reinforcing members 400 of the connector 100 of the first embodiment, the holding member 300 of the connector 100A has a structure substantially same as that of the connector 100 of the first embodiment. Accordingly, detailed explanation about those components is omitted.

Figure 19:
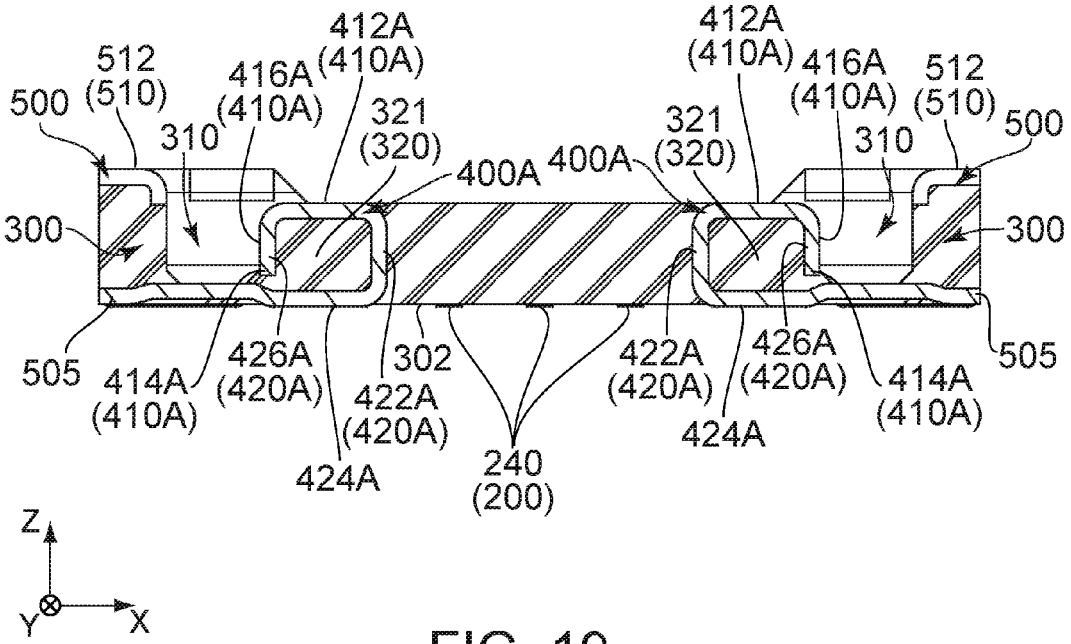
FIG. 19 is a cross-sectional view showing the connector of FIG. 17, taken along line C-C.

As shown in FIGS. 15, 17 and 19, the reinforcing members 400A are positioned at two end portions 321, respectively, of an island-like portion 320 in a first horizontal direction. In the present embodiment, the first horizontal direction is the X-direction.

As shown in FIGS. 15, 17 and 20 to 27, each of the reinforcing members 400A has a symmetrical structure with respect to a plane, wherein the plane is defined by the first horizontal direction and the up-down direction while passing through a center of the reinforcing member 400A in a second horizontal direction. In the present embodiment, the plane defined by the first horizontal direction and the up-down direction is the XZ-plane, and the second horizontal direction is the Y-direction.

As shown in FIGS. 15, 17 and 19 to 28, each of the reinforcing members 400A is made of metal and has a guard portion 410A, a supporter 420A, a lower exposed portion 424A and two resilient pieces 430A. Specifically, the guard portion 410A of each of the reinforcing members 400A guards the corresponding end portion 321 of the island-like portion 320, and the supporter 420A supports the guard portion 410A.

As shown in FIGS. 19, 23, 24 and 27, the guard portion 410A has an upper surface 412A, an embedded portion 414A and an exposed coupling portion 416A.

As shown in FIGS. 15, 17, 19 and 20, the upper surface 412A is exposed upward from the island-like portion 320 in the up-down direction. More specifically, the upper surface 412A of the present embodiment is perpendicular to the up-down direction.

As shown in FIGS. 19, 21 to 24, 27 and 28, the exposed coupling portion 416A extends downward from an outward end of the upper surface 412A in the first horizontal direction. More specifically, the exposed coupling portion 416A couples the upper surface 412A and the embedded portion 414A with each other and is exposed from the island-like portion 320.

As shown in FIGS. 19, 21, 23, 24, 27 and 28, the embedded portion 414A extends downward from a lower end of the exposed coupling portion 416A. Specifically, the embedded portion 414A of the guard portion 410A of each of the reinforcing members 400A is embedded into the corresponding end portion 321 of the island-like portion 320.

As shown in FIGS. 19 and 21 to 28, the supporter 420A has a first supporting portion 422A and a second supporting portion 426A. Specifically, each of the first supporting portion 422A and the second supporting portion 426A extends downward from the upper surface 412A in the up-down direction in the plane defined by the first horizontal direction and the up-down direction. More specifically, the first supporting portion 422A extends downward from one of two ends, or an inward end, of the upper surface 412A of the guard portion 410A in the first horizontal direction, and the second supporting portion 426A extends downward from a remaining one of the two ends, or the outward end, of the upper surface 412A of the guard portion 410A. In other words, a part of the second supporting portion 426A functions as the exposed coupling portion 416A, and a remaining part thereof functions as the embedded portion 414A. In the up-down direction, the second supporting portion 426A has a size which is not less than one half a size of the first supporting portion 422A and which is not greater than the size of the first supporting portion 422A. In other words, in the up-down direction, the second supporting portion 426A has a size C which satisfies a condition $D/2 \leq C \leq D$, wherein D is the size of the first supporting portion 422A in the up-down direction.

As understood from FIGS. 19 and 21 to 28, in the connector 100A of the present embodiment, each of the two end portions 321 of the island-like portion 320 is provided with the guard portion 410A. Accordingly, the island-like portion 320 can be prevented from being damaged when the connector 100A and a mating connector (not shown) are mated with each other under a state where the connector 100A and the mating connector (not shown) are misaligned with each other. In particular, even if downward force is applied to the upper surface 412A by a mating end (not shown) of the mating connector (not shown) abutting against the upper surface 412A of the guard portion 410A of the connector 100A when the connector 100A and the mating connector (not shown) are mated with each other, the upper surface 412A is prevented from being deformed because the upper surface 412A is supported by the first supporting portion 422A and the second supporting portion 426A so that the force applied to the upper surface 412A is distributed to the first supporting portion 422A and the second supporting portion 426A.

As shown in FIGS. 19 and 20, a region, which is defined by the first supporting portion 422A, the second supporting portion 426A and the upper surface 412A of the guard portion 410A, is filled with resin of the holding member 300. In other words, in the region defined by the first supporting portion 422A, the second supporting portion 426A and the upper surface 412A of the guard portion 410A, there is no area where the resin of the holding member 300 does not exist. Accordingly, even in a case where the mating connector (not shown) abuts against the upper surface 412A of the reinforcing member 400A when the connector 100A and the mating connector (not shown) are mated with each other, the upper surface 412A of guard portion 410A is never deformed, so that deformation of the reinforcing member 400A and damage to the island-like portion 320 can be more prevented.

As shown in FIGS. 19 to 21 and 24 to 28, the lower exposed portion 424A extends from the first supporting portion 422A and is exposed downward from the holding member 300 in the up-down direction. In the up-down direction, the lower exposed portion 424A is positioned at a position same as a position of a bottom surface 302 of the holding member 300 or protrudes downward from the bottom surface 302 of the holding member 300. More specifically, the lower exposed portion 424A of the present embodiment protrudes downward from the bottom surface 302 of the holding member 300 in the up-down direction.

As shown in FIGS. 19 to 21, 27 and 28, the lower exposed portion 424A extends to reach at least below a lower end of the second supporting portion 426A. More specifically, the lower exposed portion 424A of the present embodiment extends outward from a lower end of the first supporting portion 422A in the first horizontal direction. The lower exposed portion 424A of the present embodiment is not connected with the lower end of the second supporting portion 426A, i.e. a lower end of the embedded portion 414A. Specifically, the lower exposed portion 424A of the present embodiment is positioned to be spaced apart by a constant distance from the lower end of the second supporting portion 426A in the up-down direction. However, the present invention is not limited thereto. The lower exposed portion 424A may be configured so as to abut against the embedded portion 414A without any gap therebetween.

As described above, the connector 100A of the present embodiment has the lower exposed portion 424A, which extends from the first supporting portion 422A, and the second supporting portion 426A. The second supporting portion 426A has the size which is not less than one half the size of the first supporting portion 422A and which is not greater than the size of the first supporting portion 422A. The second supporting portion 426A is continuous with the lower exposed portion 424A through a part of the holding member 300. In a case where downward force is applied to the upper surface 412A by the mating connector (not shown) abutting against the upper surface 412A of the guard portion 410A of the connector 100A when the mating connector (not shown) is mated with the connector 100A mounted on the circuit board (not shown), the lower exposed portion 424A is moved downward to abut against the circuit board (not shown). In other words, the downward force applied to the upper surface 412A is received by the circuit board (not shown) through the lower exposed portion 424A. Accordingly, the upper surface 412A is more prevented from being deformed.

As shown in FIGS. 15, 17 and 20, each of the resilient pieces 430A is brought into contact with the mating connector (not shown) when the connector 100A and the mating connector (not shown) are mated with each other. The resilient pieces 430A extend upward from opposite ends, respectively, of the lower exposed portion 424A in the second horizontal direction. In the second horizontal direction, the island-like portion 320 is spaced apart from the two resilient pieces 430A and is positioned between the two resilient pieces 430A. First facing walls 332 of the holding member 300 correspond to the resilient pieces 430A, respectively. Recesses 334 of the first facing wall 332 correspond to the reinforcing members 400A, respectively. The resilient piece 430A is accommodated by the recess 334 of the first facing wall 332. Specifically, each of the resilient pieces 430A of each of the reinforcing members 400A is accommodated by the corresponding recess 334 of the corresponding first facing wall 332. In other words, the recess 334 of the first facing wall 332 allows the resilient piece 430A to be deformed. Specifically, each of the recesses 334 of each of the first facing walls 332 allows the corresponding resilient piece 430A of the corresponding reinforcing member 400A to be deformed. An upper end 432A of the resilient piece 430A is positioned below an upper surface 336 of the first facing wall 332 in the up-down direction. Specifically, the upper end 432A of each of the resilient pieces 430A is positioned below the upper surface 336 of the corresponding first facing wall 332 in the up-down direction.

As shown in FIGS. 15, 17, 19 and 21 to 28, the guide members 500 correspond to the reinforcing members 400A, respectively, and each of the guide members 500 is formed integrally with the corresponding reinforcing member 400A. Specifically, the reinforcing members 400A and the guide members 500 are embedded into the holding member 300 via insert-molding.

As shown in FIGS. 15, 17, 19 and 21 to 27, the first guide portion 510 faces the guard portion 410A of the reinforcing member 400A in the first horizontal direction. Specifically, the first guide portion 510 of each of the guide members 500 faces the guard portion 410A of the corresponding reinforcing member 400A in the first horizontal direction. More specifically, the first guide portion 510 of each of the guide members 500 faces each of the exposed coupling portion 416A and the embedded portion 414A of the guard portion 410A of the corresponding reinforcing member 400A in the first horizontal direction. In other words, the first guide portion 510 of each of the guide members 500 faces the second supporting portion 426A of the supporter 420A of the corresponding reinforcing member 400A in the first horizontal direction.

Figure 22:
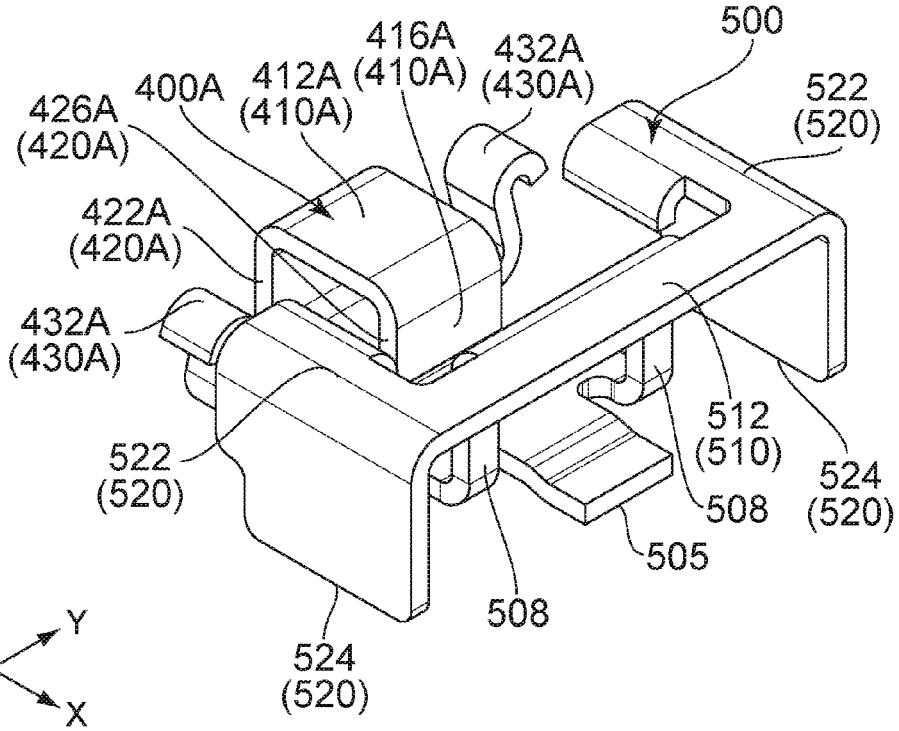
FIG. 22 is a rear, perspective view showing the reinforcing member of FIG. 21.
Figure 23:
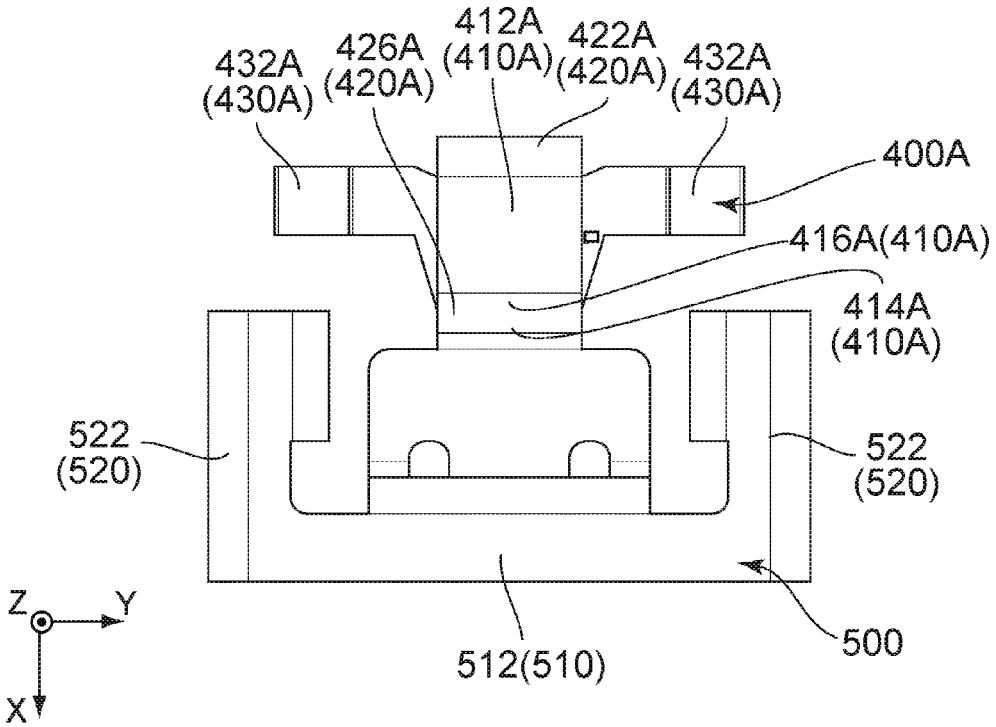
FIG. 23 is a top view showing the reinforcing member of FIG. 21.
Figure 24:
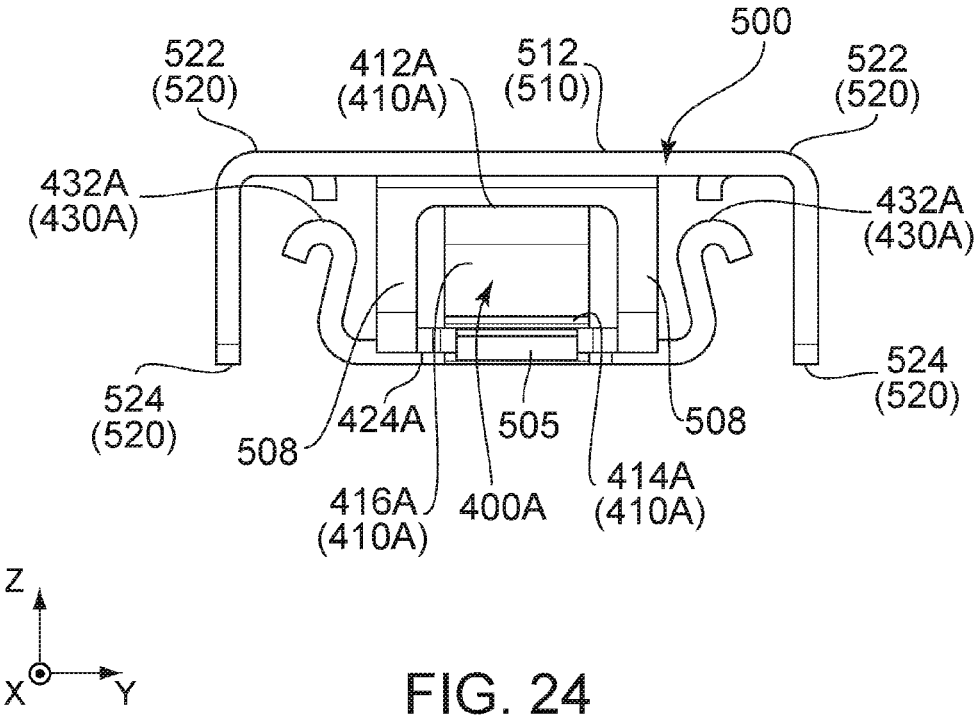
FIG. 24 is a rear view showing the reinforcing member of FIG. 21.
Figure 25:
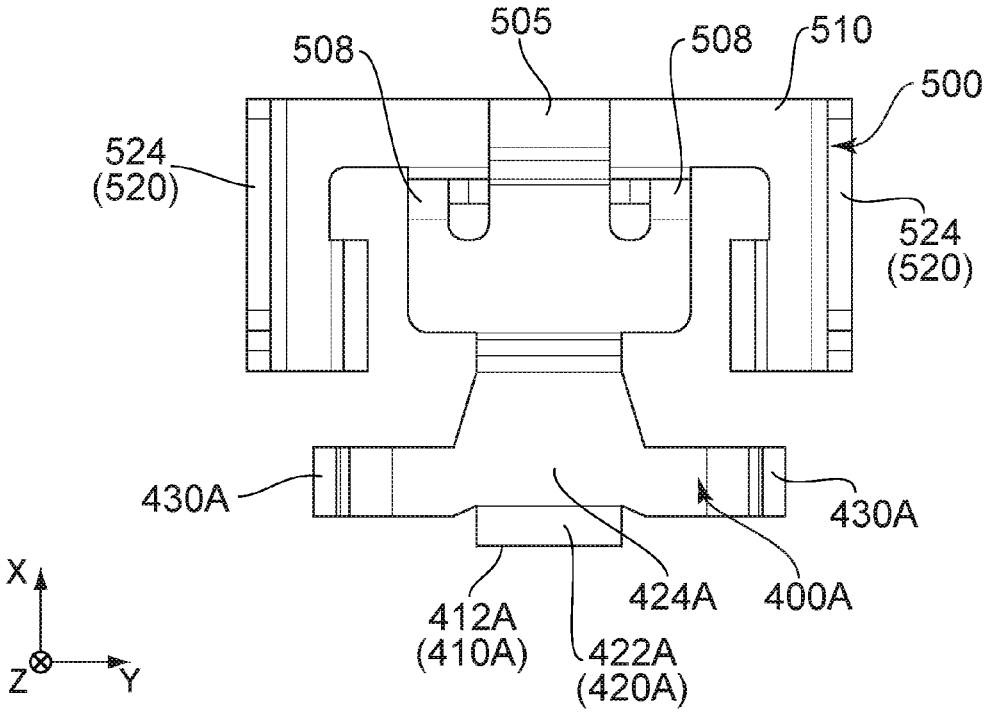
FIG. 25 is a bottom view showing the reinforcing member of FIG. 21.
Figure 26:
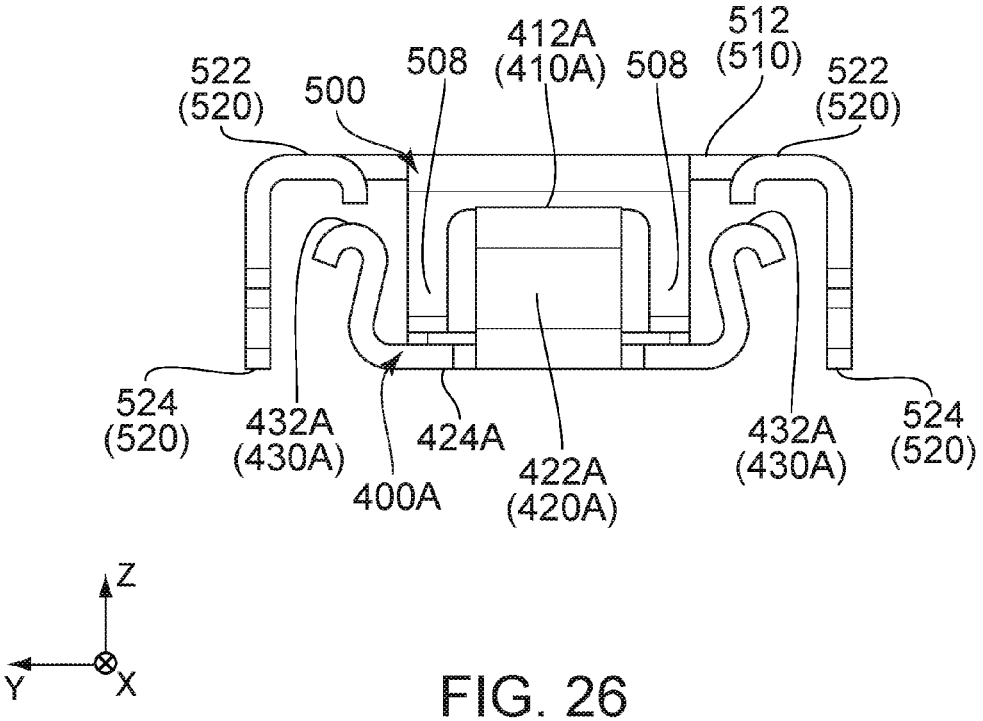
FIG. 26 is a front view showing the reinforcing member of FIG. 21.
Figure 27:
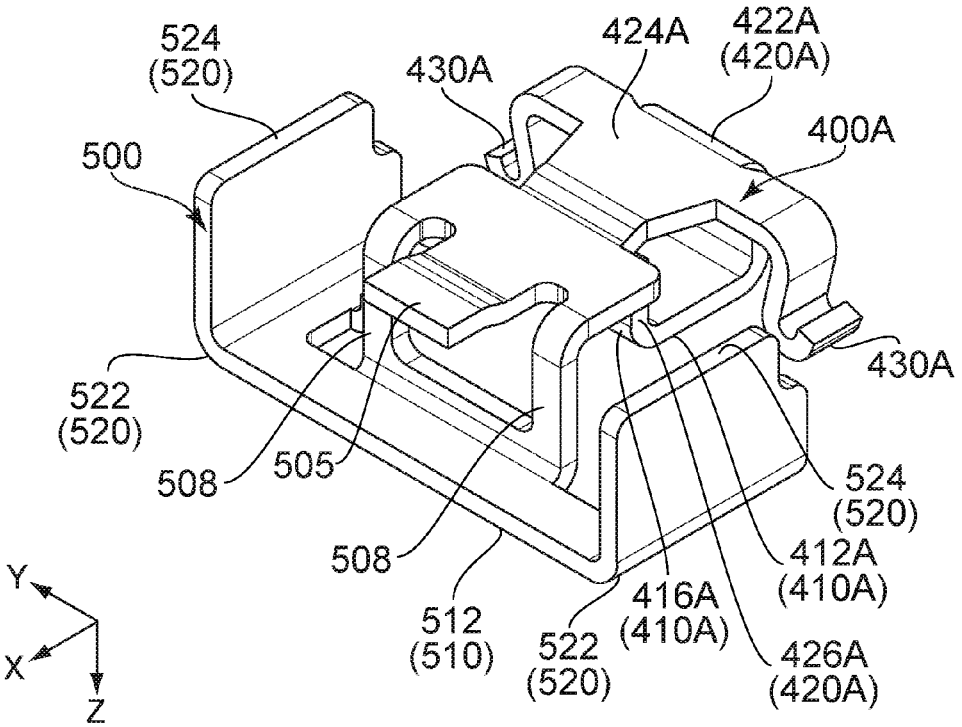
FIG. 27 is a perspective view showing a bottom surface of the reinforcing member of FIG. 21.
Figure 28:
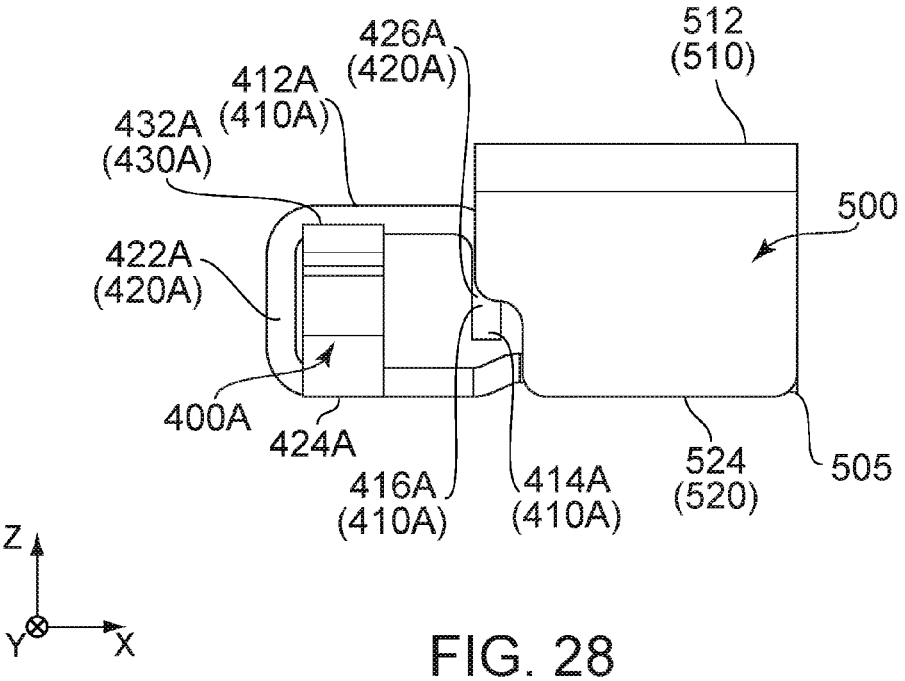
FIG. 28 is a side view showing the reinforcing member of FIG. 21.
Figure 29:
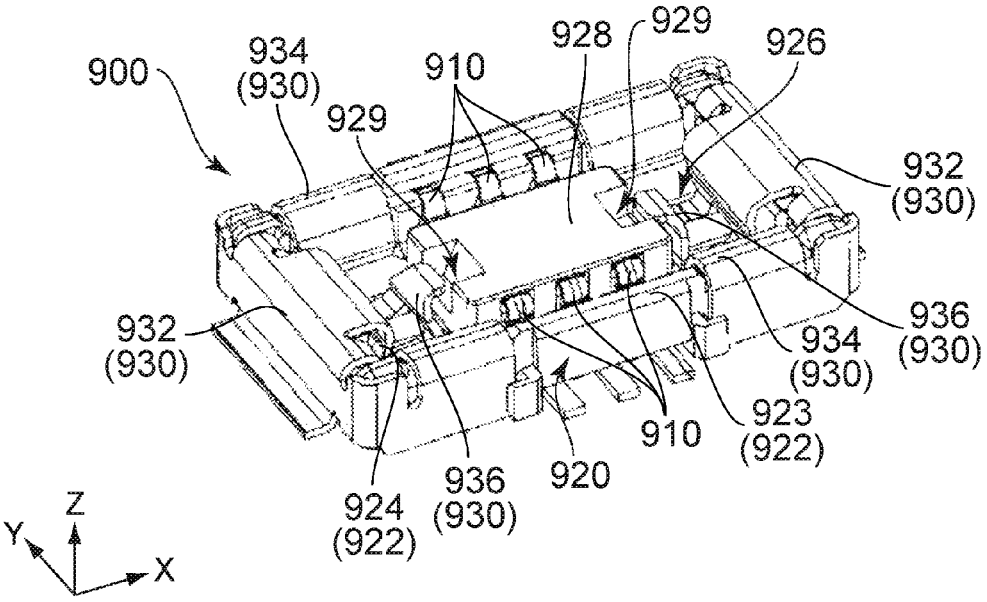
FIG. 29 PRIOR ART
FIG. 29 is a perspective view showing a connector of Patent Document 1.
Figure 30:
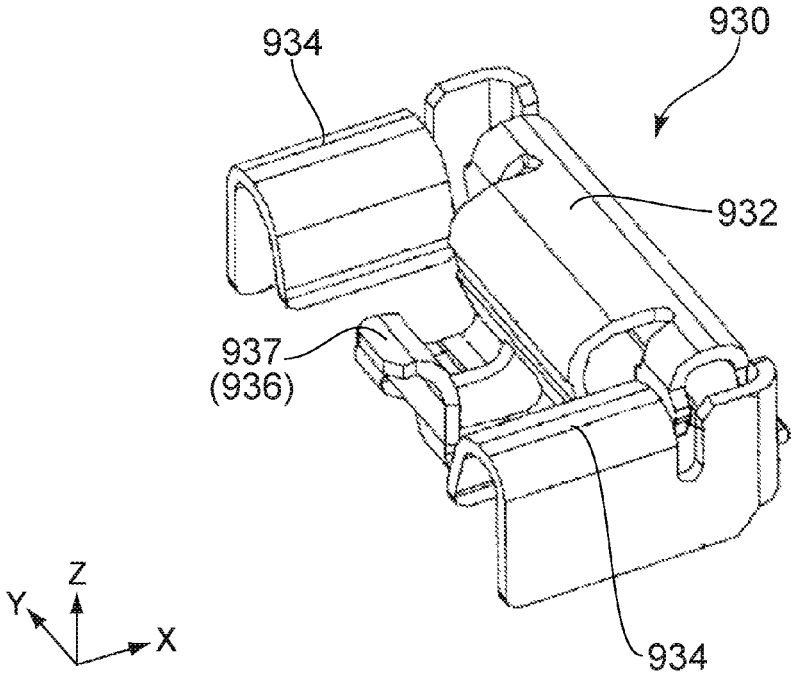
FIG. 30 PRIOR ART
FIG. 30 is a perspective view showing a reinforcing member which is included in the connector of FIG. 29.

As shown in FIGS. 22, 25 and 27, a fixed portion 505 of the illustrated guide member 500 extends in the positive X-direction from a positive X-side end of the lower exposed portion 424A of the reinforcing member 400A, and a positive X-side end of the fixed portion 505 is a free end.

As understood from FIGS. 16 and 18 to 20, similar to the first embodiment, the lower exposed portion 424A of the present embodiment is positioned above any of a lower end 524 of each of the second guide portions 520 and the free end of the fixed portion 505 in the up-down direction. The lower exposed portion 424A of the present embodiment is positioned below the bottom surface 302 of the holding member 300 in the up-down direction. In order to secure a spring property of each of the resilient pieces 430A, the lower exposed portion 424A of the present embodiment is not soldered to the circuit board (not shown).

As shown in FIGS. 19 and 20, in the up-down direction, the upper surface 412A of the guard portion 410A is positioned below any of an upper end 512 of the first guide portion 510 and an upper end 522 of each of the second guide portions 520. Specifically, in the up-down direction, the upper surface 412A of the guard portion 410A of each of the reinforcing members 400A is positioned below any of the upper end 512 of the first guide portion 510 and the upper end 522 of each of the second guide portions 520 of the corresponding guide member 500. Accordingly, in a case where the mating end (not shown) of the mating connector (not shown) is misaligned with an accommodation portion 310 of the holding member 300 of the connector 100A in the XY-plane when the connector 100A and the mating connector (not shown) are mated with each other, the mating end (not shown) of the mating connector (not shown) is brought into contact with the upper end 512 of the first guide portion 510 or/and the upper end 522 of the second guide portion 520 of the connector 100A before being brought into contact with the island-like portion 320 or/and the reinforcing member 400A of the connector 100A. Thus, in the aforementioned case, the mating end (not shown) of the mating connector (not shown) is guided toward the accommodation portion 310 of the holding member 300 of the connector 100A.

While the present invention has been described with specific embodiments, the present invention is not limited to the aforementioned embodiments.

Although the reinforcing member 400, 400A of each above-described embodiment has the first supporting portion 422, 422A and the second supporting portion 426, 426A, the upper surface 412, 412A may have another supporting portion similarly extending therefrom in addition to the first supporting portion 422, 422A and the second supporting portion 426, 426A.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along an up-down direction, wherein:

the connector comprises a contact, a holding member and two reinforcing members;

the holding member holds the contact;

the two reinforcing members are embedded into the holding member;

the holding member has an accommodation portion and an island-like portion;

the accommodation portion is configured to accommodate a part of the mating connector;

the island-like portion is arranged in the accommodation portion and protrudes upward in the up-down direction;

the island-like portion extends long in a first horizontal direction perpendicular to the up-down direction;

the island-like portion has two end portions in the first horizontal direction;

the reinforcing members are positioned at the two end portions, respectively;

each of the reinforcing members has a guard portion and a supporter;

the guard portion of each of the reinforcing members guards the corresponding end portion of the island-like portion;

the supporter supports the guard portion;

the guard portion has an upper surface, an embedded portion and an exposed coupling portion;

the upper surface is exposed upward from the island-like portion in the up-down direction;

the embedded portion is embedded into the island-like portion;

the exposed coupling portion couples the upper surface and the embedded portion with each other and is exposed from the island-like portion;

the supporter has a first supporting portion and a second supporting portion;

each of the first supporting portion and the second supporting portion extends downward from the upper surface in the up-down direction in a first plane or in a second plane, the first plane being defined by the first horizontal direction and the up-down direction, the second plane being defined by a second horizontal direction and the up-down direction, the second horizontal direction being perpendicular to both the first horizontal direction and the up-down direction; and in the up-down direction, the second supporting portion has a size which is not less than one half a size of the first supporting portion and which is not greater than the size of the first supporting portion.

2. The connector as recited in claim 1, wherein:

each of the reinforcing members has a lower exposed portion which extends from the first supporting portion; and the lower exposed portion is exposed downward from the holding member in the up-down direction.

3. The connector as recited in claim 2, wherein:

the holding member has a bottom surface in the up-down direction; and in the up-down direction, the lower exposed portion is positioned at a position same as a position of the bottom surface of the holding member or protrudes downward from the bottom surface.

4. The connector as recited in claim 2, wherein:

the lower exposed portion is a first lower exposed portion;

each of the reinforcing members has a second lower exposed portion which extends from the second supporting portion; and the second lower exposed portion is exposed downward from the holding member in the up-down direction.

5. The connector as recited in claim 4, wherein the upper surface of the guard portion is positioned between the first lower exposed portion and the second lower exposed portion in the second horizontal direction.

6. The connector as recited in claim 2, wherein:

a part of the second supporting portion functions as the exposed coupling portion;

the second supporting portion has a lower end in the up-down direction; and the lower exposed portion extends to reach at least below the lower end of the second supporting portion.

7. The connector as recited in claim 1, wherein:

each of the reinforcing members has two resilient pieces;

each of the resilient pieces is brought into contact with the mating connector when the connector and the mating connector are mated with each other; and in the second horizontal direction, the island-like portion is spaced apart from the two resilient pieces and is positioned between the two resilient pieces.

8. The connector as recited in claim 7, wherein:

the holding member has a surrounding portion;

the surrounding portion surrounds the accommodation portion in a plane perpendicular to the up-down direction;

the surrounding portion has two facing walls each of which faces the island-like portion in the second horizontal direction;

the facing walls correspond to the resilient pieces, respectively;

each of the facing walls is formed with two recesses;

the recesses correspond to the reinforcing members, respectively;

each of the recesses of each of the facing walls allows the corresponding resilient piece of the corresponding reinforcing member to be deformed;

each of the resilient pieces has an upper end in the up-down direction;

each of the facing walls has an upper surface in the up-down direction; and the upper end of each of the resilient pieces is positioned below the upper surface of the corresponding facing wall in the up-down direction.

9. The connector as recited in claim 1, wherein each of the reinforcing members has a symmetrical structure with respect to a plane, the plane being defined by the first horizontal direction and the up-down direction while passing through a center of the reinforcing member in the second horizontal direction.

10. The connector as recited in claim 1, wherein:

the holding member is made of resin;

the first supporting portion, the second supporting portion and the upper surface of the guard portion define a region; and the region is filled with the resin of the holding member.

11. The connector as recited in claim 1, wherein:

the connector further comprises two guide members;

the guide members correspond to the reinforcing members, respectively;

each of the guide members has a first guide portion and two second guide portions;

the first guide portion of each of the guide members faces the guard portion of the corresponding reinforcing member in the first horizontal direction; and the second guide portions are positioned to interpose the accommodation portion therebetween in the second horizontal direction.

12. The connector as recited in claim 11, wherein:

the first guide portion has an upper end in the up-down direction;

each of the second guide portions has an upper end in the up-down direction; and in the up-down direction, the upper surface of the guard portion of each of the reinforcing members is positioned below any of the upper end of the first guide portion and the upper end of each of the second guide portions of the corresponding guide member.

13. The connector as recited in claim 11, wherein each of the guide members is formed integrally with the corresponding reinforcing member.

* * * * *